US007170453B2

(12) United States Patent
Noguchi et al.

(10) Patent No.: US 7,170,453 B2
(45) Date of Patent: Jan. 30, 2007

(54) ANTENNA MODULE INCLUDING A PLURALITY OF CHIP ANTENNAS

(75) Inventors: Toshiharu Noguchi, Miyazaki-gun (JP); Munenori Fujimura, Miyazaki (JP); Hiromi Tokunaga, Miyazaki-gun (JP); Kenichi Kozaki, Miyazaki-gun (JP); Shigefumi Akagi, Miyazaki (JP); Shuichiro Yamaguchi, Miyazaki-gun (JP); Keisuke Maruyama, Koyu-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 33 days.

(21) Appl. No.: 10/928,118

(22) Filed: Aug. 30, 2004

(65) Prior Publication Data

US 2005/0057430 A1 Mar. 17, 2005

(30) Foreign Application Priority Data

Sep. 1, 2003 (JP) ..... P. 2003-308561
Dec. 9, 2003 (JP) ..... P. 2003-410042

(51) Int. Cl.
*H01Q 1/24* (2006.01)
*H01Q 1/36* (2006.01)

(52) U.S. Cl. ..... 343/702; 343/895

(58) Field of Classification Search ..... 343/702, 343/700 MS, 895, 873, 846
See application file for complete search history.

(56) References Cited

U.S. PATENT DOCUMENTS 5,461,386 A 10/1995 Knebelkamp
5,561,430 A 10/1996 Knebelkamp
5,764,197 A 6/1998 Tsuru et al.
5,898,413 A 4/1999 Mandai et al.
5,903,242 A 5/1999 Tsuru et al.
5,914,693 A 6/1999 Takei et al.
5,936,593 A 8/1999 Mandai et al.
5,949,385 A 9/1999 Asakura et al.
5,973,651 A 10/1999 Suesada et al.
5,977,927 A 11/1999 Mandai et al.
6,028,554 A * 2/2000 Mandai et al. ..... 343/700 MS
6,054,956 A 4/2000 Mandai et al.
6,064,351 A 5/2000 Mandai et al.

(Continued)

FOREIGN PATENT DOCUMENTS

EP 0 831 546 3/1998

(Continued)

*Primary Examiner*—Hoanganh Le
(74) *Attorney, Agent, or Firm*—Wenderoth, Lind & Ponack, L.L.P.

(57) ABSTRACT

An antenna apparatus includes a plurality of antennas having different resonance frequencies and a feeding section for supplying common power to feeding terminals of the plurality of antennas. Open terminals of the plurality of antennas are separate. As at least one of the plurality of antennas is implemented as a helical antenna having a helical conductor section trimmed, the transmission-reception band can be put into a wide band. Further, an antenna apparatus includes a plurality of antennas, a connection conductor provided between the antennas for connecting the antennas in series, a feeding section provided in one of terminal sections to which the connection conductor is not connected in the plurality of antennas connected in series, and an additional conductor provided in the other terminal section to which the connection conductor is not connected, wherein the additional conductor is an open end part.

15 Claims, 34 Drawing Sheets

U.S. PATENT DOCUMENTS

| | | | | |
|---|---|---|---|---|
| 6,181,001 | B1 | 1/2001 | Ikefuji et al. | |
| 6,288,680 | B1 | 9/2001 | Tsuru et al. | |
| 6,486,853 | B1 | 11/2002 | Yoshinomoto et al. | |
| 6,693,604 | B1 | 2/2004 | Washiro et al. | |
| 6,958,730 | B1 * | 10/2005 | Nagumo et al. | 343/702 |
| 2002/0033778 | A1 | 3/2002 | Yoshinomoto et al. | |
| 2003/0011532 | A1 | 1/2003 | Yoshinomoto et al. | |
| 2004/0108967 | A1 * | 6/2004 | Fujimura et al. | 343/895 |

FOREIGN PATENT DOCUMENTS

| | | |
|---|---|---|
| EP | 0 863 571 | 9/1998 |
| EP | 0 872 912 | 10/1998 |
| EP | 1 239 533 | 9/2002 |
| EP | 1 313 169 | 5/2003 |
| JP | 5-013291 | 1/1993 |
| JP | 5-226926 | 9/1993 |
| JP | 9-199939 | 7/1997 |
| JP | 10-065432 | 3/1998 |
| JP | 10-200438 | 7/1998 |
| JP | 10-247806 | 9/1998 |
| JP | 10-313208 | 11/1998 |
| JP | 11-004117 | 1/1999 |
| JP | 2002-124812 | 4/2002 |
| JP | 2002-319810 | 10/2002 |
| JP | 2003-101342 | 4/2003 |
| JP | 2003-163521 | 6/2003 |
| WO | 00/70710 | 11/2000 |

* cited by examiner

EQUIVALENT CIRCUIT

FIG. 12A
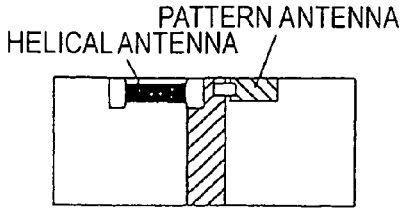
FIG. 12B
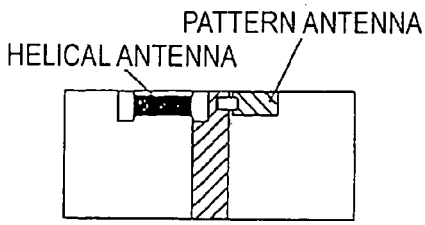
FIG. 12C
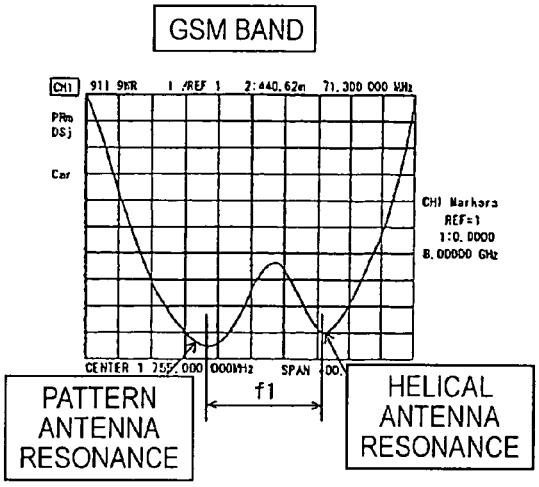
FIG. 12D
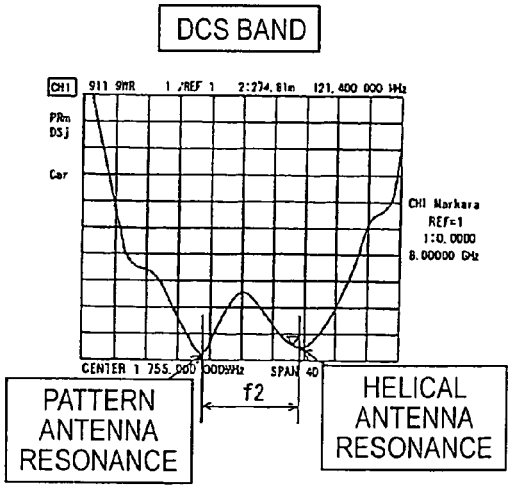
FIG. 12E
XY-PLANE H-V AVERAGE GAIN
| | | GSM BAND | | DCS BAND | |
|---|---|---|---|---|---|
| f1 (GSM) | f2 (DCS) | 898MHz | 943MHz | 1748MHz | 1843MHz |
| 75MHz | 120MHz | -0.7 | -2.0 | -6.9 | -5.8 |
| 60MHz | 100MHz | -0.6 | -2.0 | -6.2 | -5.6 |
| 45MHz | 80MHz | -0.4 | -1.8 | -6.2 | -5.5 |

FIG. 21A
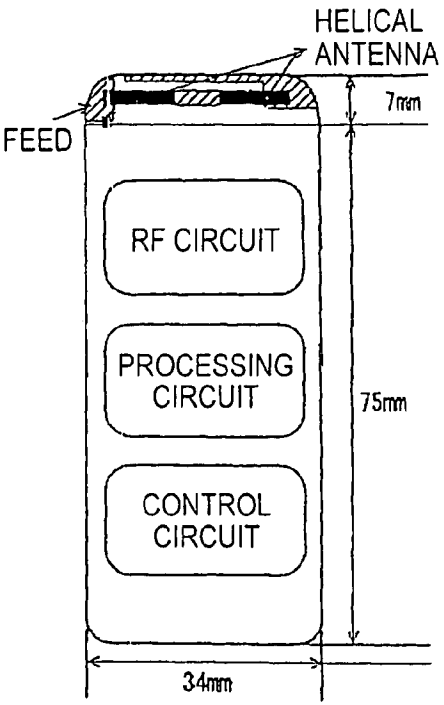
INSTALLATION EXAMPLE OF ANTENNA MODULE OF THE INVENTION IN MOBILE-TELEPHONE
FIG. 21B
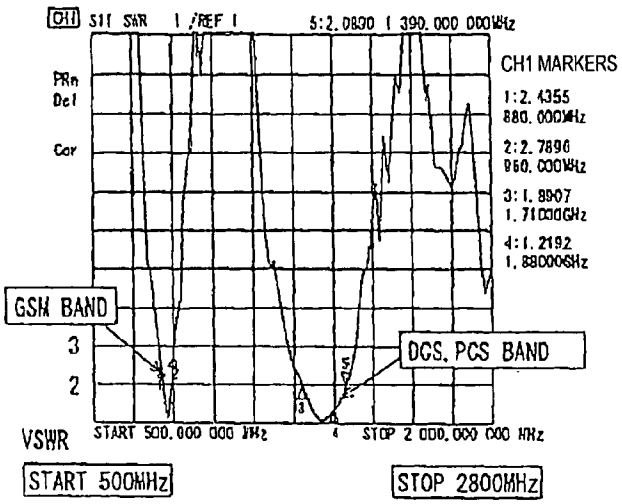
VSWR IN THE INVENTION
FIG. 21C
GAIN
| | |
|---|---|
| 898MHz | -2.2 |
| 943MHz | -2.0 |
| 1748MHz | -3.9 |
| 1843MHz | -3.1 |
| 1960MHz | -4.1 |
(dBi)
GAINS IN THE INVENTION
FIG. 21D
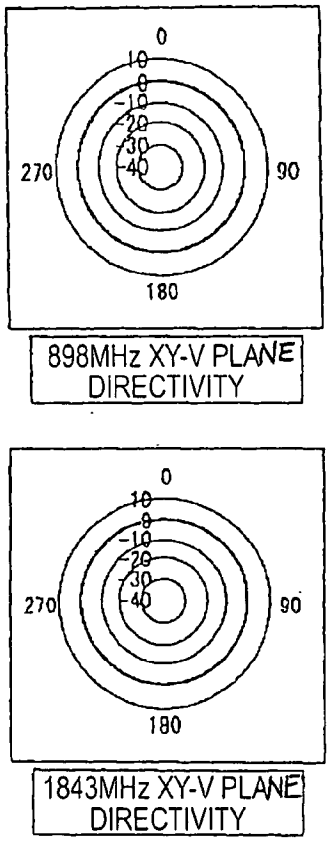
DIRECTIVITY IN THE INVENTION FIG. 22A
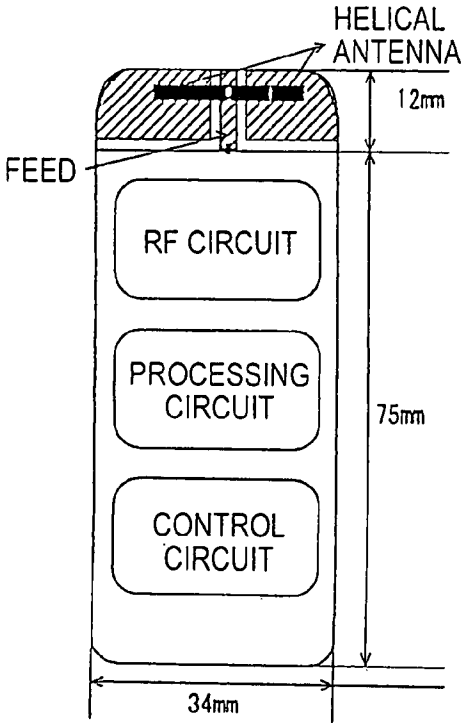
INSTALLATION EXAMPLE OF ANTENNA MODULE IN RELATED ART IN MOBILE TELEPHONE
FIG. 22B
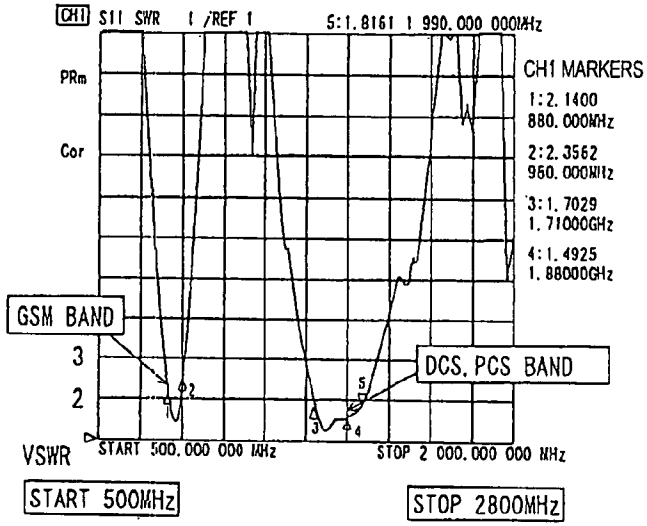
VSWR IN RELATED ART
FIG. 22C
| | GAIN |
|---|---|
| 898MHz | -3.2 |
| 943MHz | -3.2 |
| 1748MHz | -3.6 |
| 1843MHz | -3.4 |
| 1960MHz | -4.1 |
(dBi)
GAINS IN RELATED ART
FIG. 22D
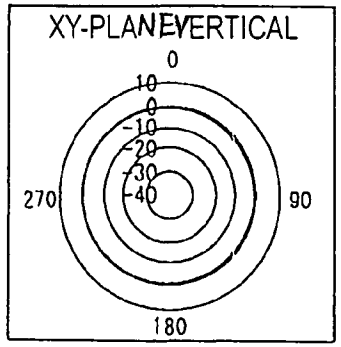
898MHz XY-V PLANE DIRECTIVITY
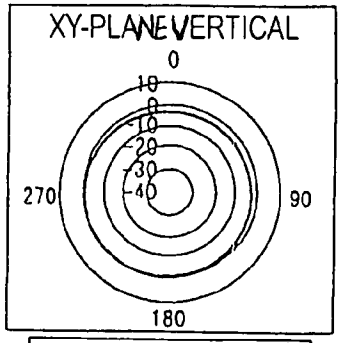
1843MHz XY-V PLANE DIRECTIVITY
DIRECTIVITY IN RELATED ART FIG. 23A
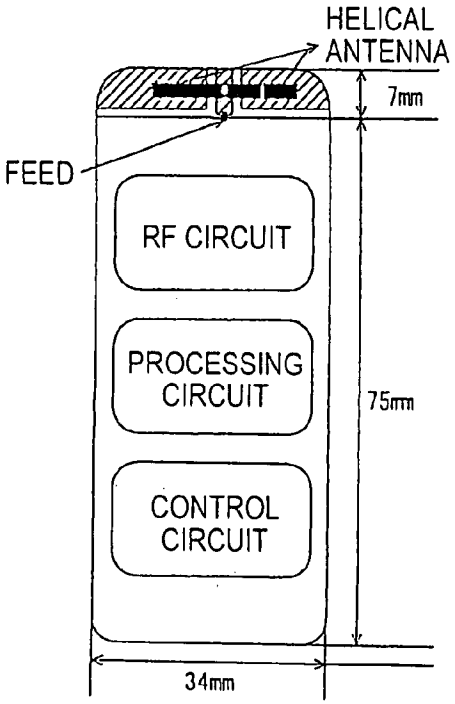
INSTALLATION EXAMPLE OF ANTENNA MODULE IN RELATED ART IN MOBILE TELEPHONE (MAKING ANTENNA AREA EQUAL TO THAT IN THE INVENTION)
FIG. 23B
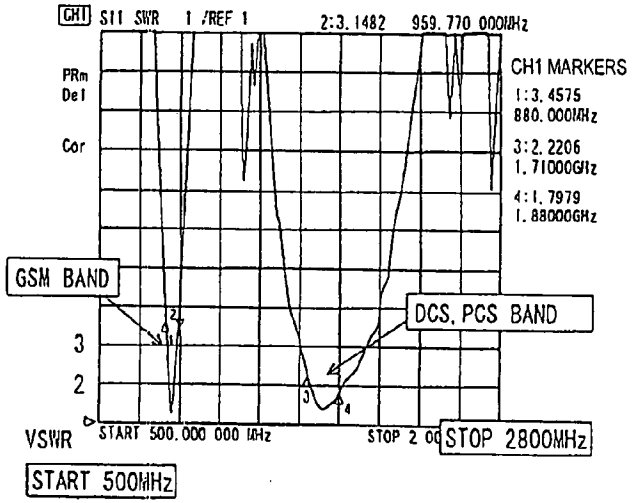
VSWR IN RELATED ART
FIG. 23C
| | GAIN |
|---|---|
| 898MHz | -3.9 |
| 943MHz | -4.1 |
| 1748MHz | -3.9 |
| 1843MHz | -4.5 |
| 1960MHz | -4.2 |
(dBi)
GAINS IN RELATED ART
FIG. 23D
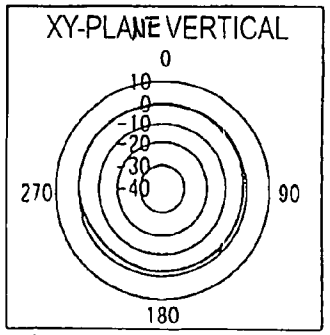
898MHz XY-V PLANE DIRECTIVITY
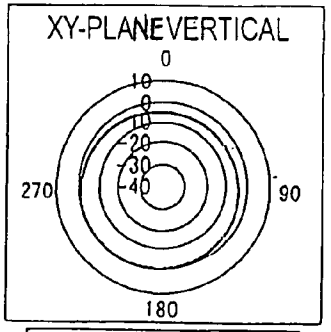
1843MHz XY-V PLANE DIRECTIVITY
DIRECTIVITY IN RELATED ART

ANTENNA MODULE INCLUDING A PLURALITY OF CHIP ANTENNAS

BACKGROUND OF THE INVENTION

This invention relates to an antenna module suitable for use with electronic equipment which conducts radio communications, such as a mobile communication terminal or a personal computer.

In recent years, there has been a growth in portable terminals having a chip antenna installed therein to conduct radio communications of data with other electronic equipment in addition to a whip antenna or an internal antenna provided for voice communications.

There has also been a growth in conducting data communications by radio using a radio LAN, etc., in portable-type mobile electronic equipment such as a notebook personal computer, and there has also been a growth in electronic equipment each containing a chip antenna.

Further, miniaturization and low power consumption have been indispensable for recent mobile telephones, notebook computers, etc., and miniaturization of an antenna apparatus has been demanded. Providing an antenna with a wide band has been required with an increase in the transmission capacity in recent years. Further, providing a wide band has been required increasingly in a multicarrier system such as an OFDM system (orthogonal frequency demodulation multiplex).

To increase the load capacity of an antenna to provide the antenna with a wide band, an antenna module with an additional conduction section added to the tip of the antenna is proposed, for example, in JP-A-2002-124812 or JP-A-10-247806. FIGS. 37 and 38 are top views of antenna modules in related arts and show the case where an additional conductor section is added to the tip of an antenna element.

Numeral 100 denotes an antenna module, numeral 101 denotes a meander antenna, numeral 102 denotes a feeding section, and numeral 103 denotes an additional conductor. The meander antenna 101 is formed of a board pattern, etc. The additional conductor 103 is formed at the tip of the meander antenna 101 and the tip is an open end. A signal current is supplied from the feeding section 102 and the supplied signal is emitted according to the resonance frequency of the meander antenna 101. Reception is also performed in a similar manner. At this time, with the additional conductor 103 as a load capacity, the load impedance seen from the feeding section 102 increases, the peak of the frequency curve becomes gentle, and the frequency band is enlarged.

FIG. 38 shows how two meander antennas 101 are arranged in parallel to deal with multiple resonances and a separate additional conductor 103 is formed at the tip of each of the meander antennas 101.

However, to form an additional conductor at the tip of a pattern antenna such as a meander antenna, the pattern antenna itself requires a large area and thus the antenna module is upsized, which is a problem.

In a recent portable terminal, notebook personal computer, etc., an antenna module of multiple resonance has been required for one terminal to cover a plurality of frequency standards. Thus, if a plurality of antennas are arranged in parallel, each antenna requires a separate additional conductor, the antenna module is upsized, and apparatus incorporating the antenna module becomes difficult to miniaturize, which is a problem.

Particularly, to provide separate additional conductors, it is necessary to provide each antenna with a wide band with each additional conductor and each additional conductor is upsized, leading to upsizing the antenna module containing the additional conductors, which is a problem.

SUMMARY OF THE INVENTION

It is an object of the invention to provide an antenna module for enabling wide-band transmission and reception while being miniaturized.

According to the present invention, an antenna module includes: an installation body; and a plurality of chip antennas, in which the plurality of chip antennas are connected by a connection conductor and are installed on the installation body.

Preferably, a signal current is supplied as the plurality of chip antennas are connected in parallel by the connection conductor with the connection conductor as the reference.

Preferably, a signal current is supplied as the plurality of chip antennas are connected in series with the connection conductor as the reference.

In the invention, a plurality of antennas are connected to a connection conductor, so that the bands of the antennas can be concatenated for providing a wide band. Accordingly, it is made possible to conduct communications at a high transmission rate requiring a wide band.

Moreover, a plurality of antennas are connected in series and power is supplied from the common feeding section, whereby a multiple-resonance antenna module operating at a plurality of frequencies can be provided.

BRIEF DESCRIPTION OF THE DRAWINGS

FIG. 12A is a schematic drawing of an antenna apparatus covering a GSM band; FIG. 12B is a schematic drawing of an antenna apparatus covering a DCS band; FIG. 12C is a frequency characteristic drawing of the experimental results in the GSM band; FIG. 12D is a frequency characteristic drawing of the experimental results in the DCS band; and FIG. 12E is a drawing to show the gain results;

FIG. 21A is an installation drawing of the antenna module of the invention in a mobile telephone; FIG. 21B is a VSWR drawing of the antenna module of the invention; FIG. 21C is a list to show the gains of the antenna module of the invention; and FIG. 21D is directivity diagrams of the antenna module of the invention;

FIG. 22A is an installation drawing of an antenna module in a related art in a mobile telephone; FIG. 22B is a VSWR drawing of the antenna module in the related art; FIG. 22C is a list to show the gains of the antenna module in the related art; and FIG. 22D is directivity diagrams of the antenna module in the related art;

FIG. 23A is an installation drawing of an antenna module in a related art in a mobile telephone; FIG. 23B is a VSWR drawing of the antenna module in the related art; FIG. 23C is a list to show the gains of the antenna module in the related art; and FIG. 23D is directivity diagrams of the antenna module in the related art;

DETAILED DESCRIPTION OF THE PREFERRED EMBODIMENTS

Referring now to the accompanying drawings, there are shown preferred embodiments of the invention.

First Embodiment

Figure 1:
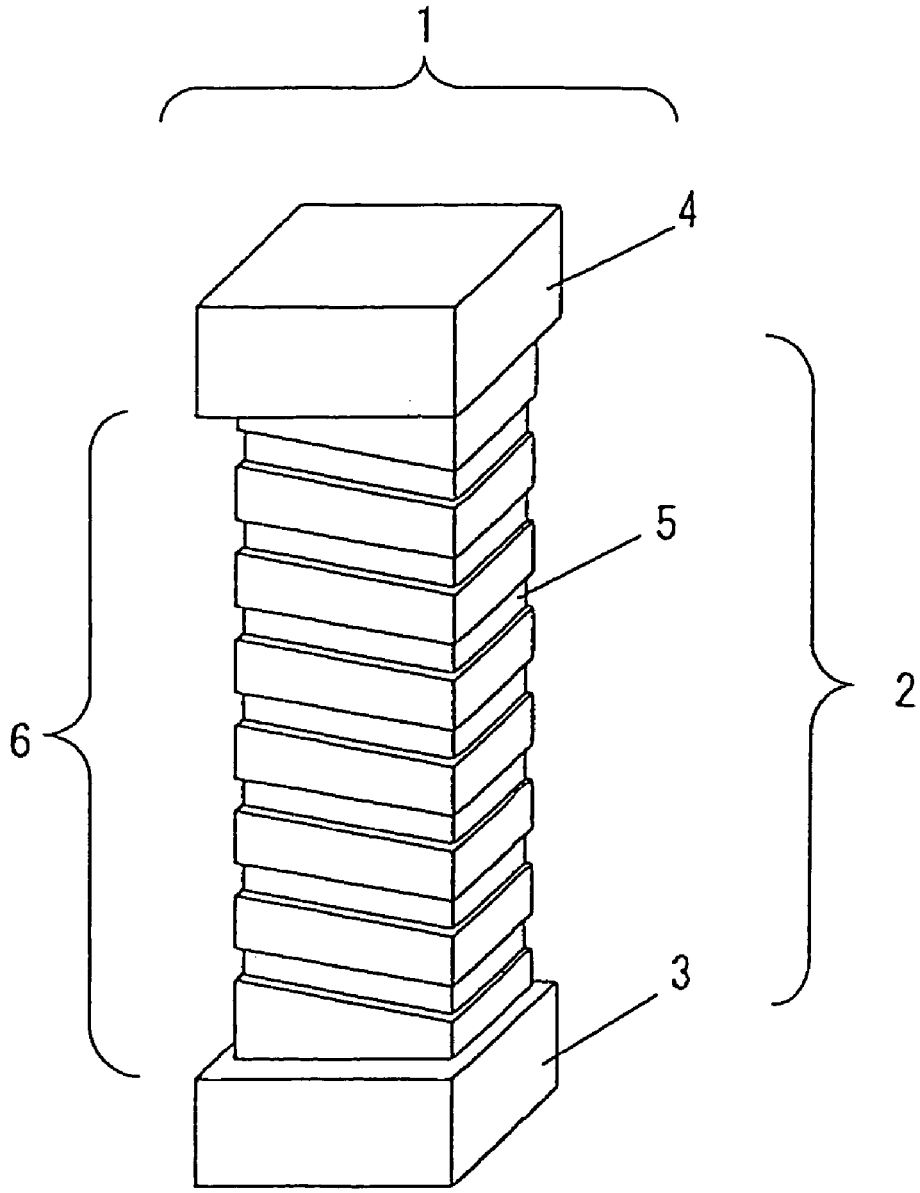
FIG. 1 is a perspective view of a helical antenna in a first embodiment of the invention.
Figure 2:
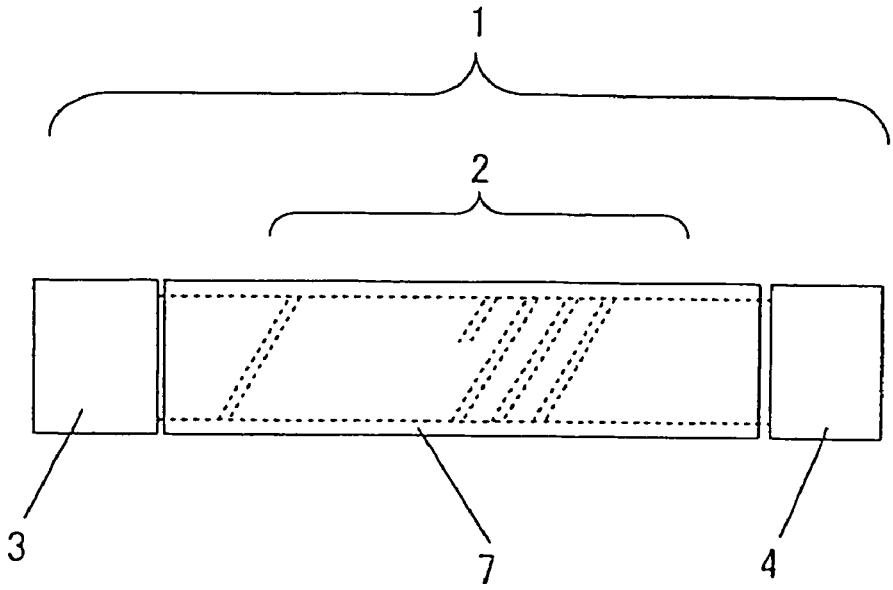
FIG. 2 is a perspective view of the helical antenna in the first embodiment of the invention.
Figure 3:
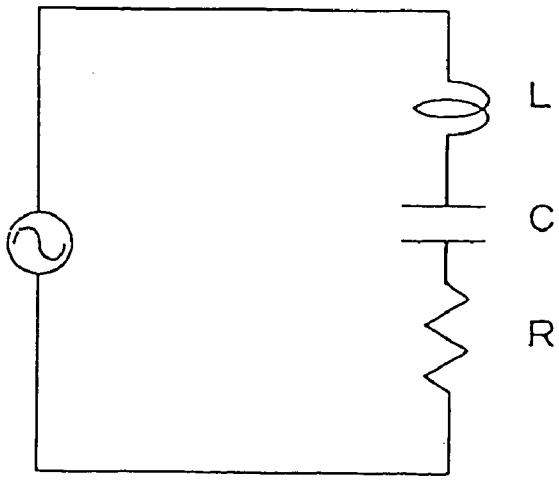
FIG. 3 is an equivalent circuit diagram of the helical antenna in the first embodiment of the invention.
Figure 4:
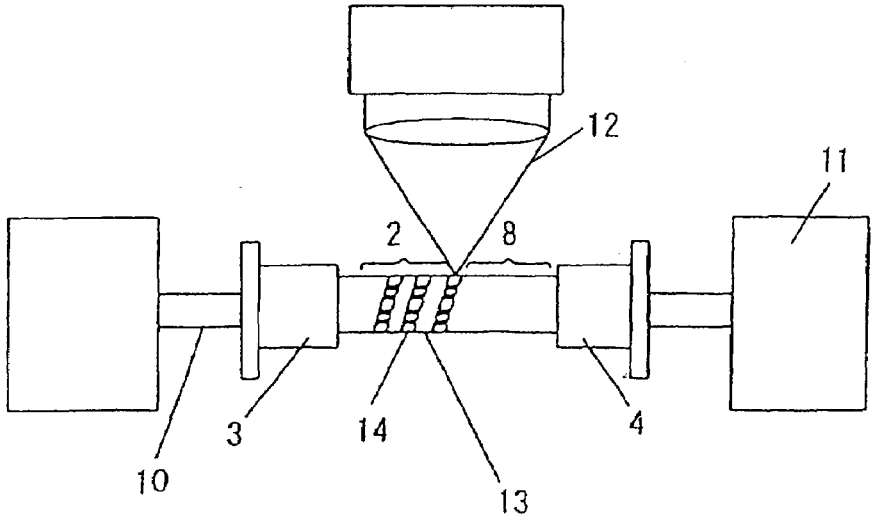
FIG. 4 is a manufacturing process drawing of the helical antenna in the first embodiment of the invention.

FIGS. 1 and 2 are perspective views of a helical antenna in a first embodiment of the invention. FIG. 3 is an equivalent circuit diagram of the helical antenna in the first embodiment of the invention. FIG. 4 is a manufacturing process drawing of the helical antenna in the first embodiment of the invention.

Numeral 1 denotes a helical antenna, numeral 2 denotes a helical section, numerals 3 and 4 denote terminal sections, numeral 5 denotes a spiral groove, numeral 6 denotes a base body, and numeral 7 denotes a protective film. One of the terminal sections 3 and 4 is connected to a feeding section and the other is connected to an open section.

The configuration of the helical antenna will be discussed with FIG. 1.

The base body 6 is formed by pressing, extruding, etc., a dielectric, an insulator such as ceramic material of alumina or mainly consisting of alumina, or the like. As a component material of the base body 6, ceramic material of forsterite, magnesium titanate base, calcium titanate base, zirconia tin titanium base, barium titanate base, lead calcium titanium base, etc., may be used and resin material of epoxy resin, etc., may be used. In the first embodiment, ceramic material of alumina or mainly consisting of alumina is used from the viewpoint of strength, insulation properties, or ease of working. Further, one or more conductive films made of a conductive material of copper, silver, gold, nickel, etc., are deposited on the whole of the base body 6 to form a surface having conductivity. Plating, vapor deposition, sputtering, paste, etc., is used for producing the conductive film.

The terminal sections 3 and 4 are formed on opposite ends of the base body 6. At least one of parts formed by thin films of conductive plated film, evaporated film, sputtered film, etc., applying silver paste, etc., and baking, etc., and the like is used.

The base body 6 may have a cross section of the same size as that of the terminal section 3, 4. Further, it may undergo gradation and may have a smaller cross-sectional area than the terminal section 3, 4. As the outer periphery of the base body 6 is gradated, it is possible for the base body 6 to have a distance from the surface of the antenna installation board at the installing time, and it is possible to prevent degradation of the characteristics. At the time, the base body 6 may have a partial or fully gradated face. If the base body 6 has the fully gradated face, which face is to be brought into contact with an electronic board need not be taken into consideration at the installing time, and the cost at the installing time can be decreased.

The base body 6 may have chamfered corners. As the chamfers are provided, a breakage of the base body 6 is prevented, the conductive film is prevented from thinning, or damage to the helical section 2 is prevented.

The base body 6 and the terminal sections 3 and 4 may be separately formed and later bonded, etc., so that they are put into one piece, or may be previously formed in one piece. The base body 6 may be shaped like a polygon such as a triangle, a pentagon or a circular column rather than a rectangle of a quadrangle. If the base body 6 is shaped like a circular column, corners are eliminated, so that shock resistance is enhanced and formation of the spiral groove 5 is facilitated.

The helical section 2 is formed with the spiral groove 5 by spirally cutting the surface of the base body 6 having conductivity by trimming with a laser, etc., and an inductor component is provided. The helical section 2 is connected at one end to the terminal section 3 and at an opposite end to the terminal section 4, and a capacitance component is provided between the connections. That is, the inductor component and the capacitance component are connected according to a series connection structure. The helical antenna 1 may be a λ/4 type antenna or may be a λ/2 type antenna. To further promote miniaturization, the former is often used, in which case a transmission-reception gain is secured using an image current occurring on the ground existing in the proximity of the helical antenna 1.

Although not shown in FIG. 1, one of the terminal sections 3 and 4 is connected to a feeding section and the other is connected to an open section. The feeding section is formed of a solder land, etc., and likewise the open section is also formed of a solder land, etc. At this time, lead-free solder is used for the solder land, so that it is made possible to provide an electronic apparatus less adversely affecting the environment.

Next, the helical antenna 1 shown in FIG. 2 has the protective film 7 formed on the surface thereof. As the protective film 7 is provided, it is possible to prevent damage to the conductive film of the base body 6 and damage to the spiral groove 5, etc. Particularly, it is possible to protect the helical antenna from shock and heat at the transporting time and at the installing time. A tube-like or paste-like protective film is used as the protective film 7.

The paste-like protective film is implemented by applying a coat of a resin material such as epoxy resin. If the protective film 7 is formed by applying a coat of material, etc., it is feared that the protective film 7 may enter the inside of the spiral groove 5 and may vary the resonance frequency of the antenna, if the protective film 7 is a material having a high dielectric constant. Thus, preferably a material having a low dielectric constant is used for the protective film 7. However, the dielectric constant of the protective film 7 is considered to some extent for designing the shape and the size of the helical section, so that the antenna characteristics of any desired frequency, etc., can be provided. Preferably, the protective film 7 is formed so that it is placed in the gradation part of the base body 6, and so that the height of the side of the terminal section 3, 4 becomes equal to or less than the height of the side of the protective film 7. Accordingly, the ease of work at the installing time onto the antenna installation board is secured.

The tube-like protective film is implemented by placing a protective film shaped like a tube on the periphery of the base body 6, heating the protective film, and crimping the protective film onto the base body 6. Since the tube-like protective film is formed so as to cover the helical section 2, the protective film does not flow into the inside of the spiral groove 5. Thus, variation in the antenna characteristics caused by providing the tube-like protective film does not occur. Preferably, a protective film made of resin and moreover having heat-shrinkable properties is selected as the tube-like protective film. As the tube-like protective film is put on the base body 6 and heat treatment is conducted, the tube is shrunk and the tube-like protective film can be reliably formed on the base body 6.

Preferably, the protective film 7 is formed on the surface of the base body 6 and is formed so as to cover at least the helical section 2. Although the terminal section 3, 4 may also be covered with the protective film 7, the adverse effect at the installing time can be avoided as the protective film 7 is formed except for the terminal section 3, 4. The colors of the protective film 7 and the terminal section 3, 4 are made different, whereby it is made possible to easily distinguish the terminal section 3, 4 from other parts in the helical antenna 1 in image recognition at the automatic installing time. In this case, connecting of any other part than the terminal section 3, 4 to the solder land, etc., can be prevented at the installing time.

Next, the operation of the helical antenna will be discussed with FIG. 3. FIG. 3 represents an equivalent circuit of the helical antenna. The helical section 2 provided with the spiral groove 5 has an inductor component L, portions other than the helical section 2 have a capacitance component C, and the inductor component L and the capacitance component C are connected in series. As is clear from the equivalent circuit, resonance frequency ω is represented by the following (expression 1):

$$\omega = \frac{1}{\sqrt{LC}} \qquad \text{[Expression 1]}$$

As is clear from (expression 1), the resonance frequency is defined by the inductor component L and the capacitance component C and consequently, the transmission-reception frequency of the helical antenna 1 is determined by the inductor component L and the capacitance component C. Therefore, the helical antenna 1 operates according to the transmission-reception frequency defined by (expression 1), and transmits and receives a radio wave.

The inductor component is defined in proportion to the number of windings of the spiral groove 5 and the resonance frequency is inversely proportional to the value of the square root of the inductor component. Thus, the number of windings of the spiral groove 5 implementing the inductor component in the feeding section is lessened, so that higher resonance frequency can be provided.

Next, the manufacturing method of the helical antenna 1 will be discussed with FIG. 4.

Numeral 10 denotes a rotation support bed, numeral 11 denotes a motor, numeral 12 denotes a laser radiation device, numeral 13 denotes a base body with conductive film, and numeral 14 denotes a spiral groove. Like the base body 6, the base body with conductive film 13 is also formed by pressing, extruding, etc., a dielectric material, an insulator such as ceramic material of alumina or mainly consisting of alumina, or the like. Further, the conductive film of the base body with conductive film 13 is formed by depositing one or more conductive films made of conductive material of copper, silver, gold, nickel, etc.

As shown in FIG. 4, the base body with conductive film 13 is placed on the rotation support bed 10 and is rotated by the motor 11, the base body with conductive film 13 is radiated with a laser beam from the laser radiation device 12, and at least one of the laser radiation device 12 and the rotation support bed 10 is moved, whereby the spiral groove 14 is formed. At this time, the spiral groove 14 is cut reliably exceeding the conductive film and a helical conductive film remains, whereby the helical section 2 having the helical conductive film is formed. Cutting with a grind stone, etc., may be used rather than laser radiation.

In the formation method described above, the base body with conductive film 13 is wholly formed with the conductive film and thus the terminal sections 3 and 4 are also formed on the surfaces with the conductive film, of course. Therefore, the conductive film provided on the terminal section 3, 4 may be used as a connection face at the installing time. At least one of a corrosion resistance film such as nickel (or a solder corrosion prevention film) and a joint film made of lead-free solder provided by adding to Sn any other metal (except lead) may be further provided on the conductive film of the surface of the terminal section 3, 4. The conductive film may be provided only on the base body surface except the end parts and a conductive paste material of silver paste, etc., may be applied onto the surface of the terminal section 3, 4 and baked, and moreover the baked conductor and the conductive film may be electrically connected for forming the terminal section 3, 4. At least one of a resist and a joint film may be provided on the baked conductor. Thus, it is made possible to manufacture the helical antenna 1.

The helical section 2 may be formed by winding a linear body such as a lead wire around the base body. In this case, a member such as an adhesive or a resin mold may be used to fix the linear body onto the base body 6. The thickness, the length, etc., of the helical section 2 can be found appropriately by experiment in response to the characteristics of the electronic apparatus using the helical antenna.

Next, providing an antenna with a wide band will be discussed.

Figure 5:
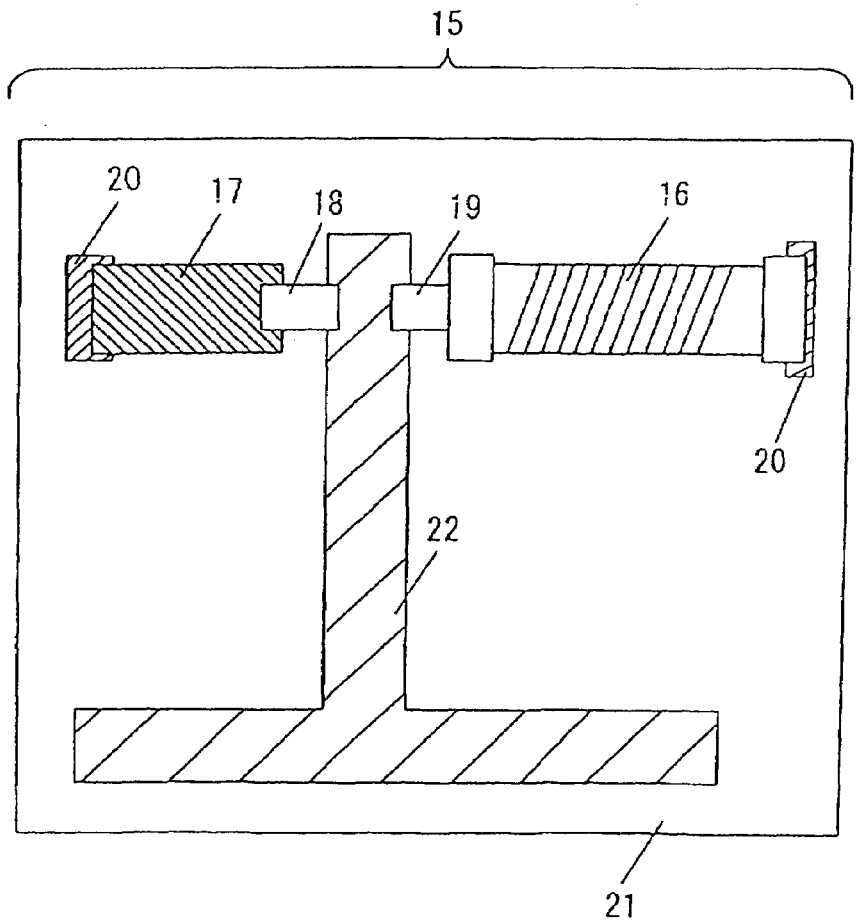
FIG. 5 is a drawing to show the configuration of an antenna apparatus in the first embodiment of the invention.
Figure 6:
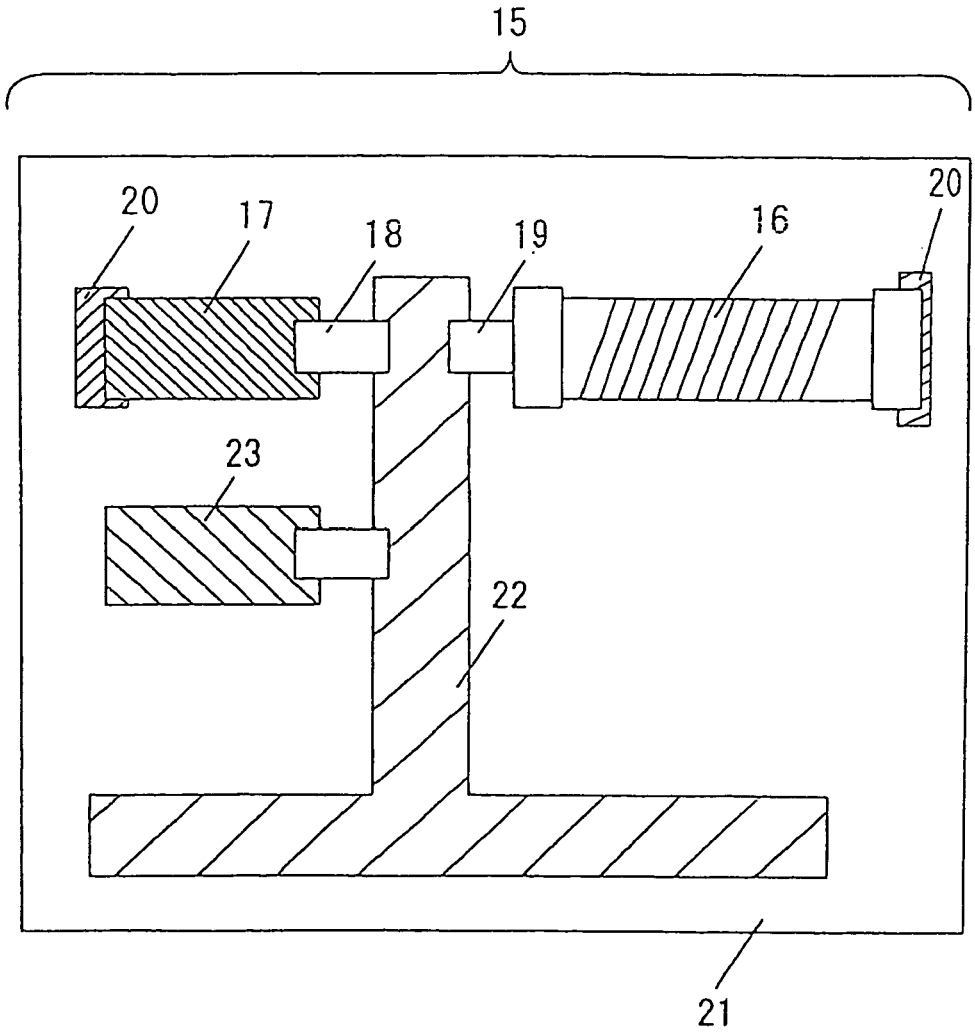
FIG. 6 is a drawing to show the configuration of an antenna apparatus in the first embodiment of the invention.

FIGS. 5 and 6 are drawings to show the configurations of the antenna apparatus in the first embodiment of the invention.

Numeral 15 denotes an antenna apparatus, numeral 16 denotes a first antenna, numeral 17 denotes a second antenna, numerals 18 and 19 denote matching elements, numeral 20 denotes an open section, numeral 21 denotes an antenna board, and numeral 22 denotes a feeder line. The first antenna 16 may be a helical antenna as shown in FIG. 5, may be a pattern antenna on the board, or may be any other type of antenna. Likewise, the second antenna 17 may be a helical antenna, may be a pattern antenna on the board, or may be any other type of antenna. In FIG. 5, a helical antenna is shown as the first antenna and a pattern antenna is shown as the second antenna. It is proper to select a helical antenna or a pattern antenna as the antenna to be used depending on manufacturing optimization and cost optimization. The resonance frequencies of the first antenna 16 and the second antenna 17 are not the same and are close frequencies.

The matching elements 18 and 19 are elements of inductors, capacitors, etc., and are provided for impedance matching between the first antenna 16 and the feeder line 22 and between the second antenna 17 and the feeder line 22. The feeder line 22 may be a feeder pattern formed on the antenna board 21 as shown in FIG. 5 or may be a conductive wire such as a coaxial cable or a copper wire.

As is clear from FIG. 5, power is supplied through the common feeder line 22 to the two antennas, namely, the first antenna 16 and the second antenna 17. Accordingly, a common signal current is supplied to the first antenna 16 and the second antenna 17, and the signals received at the first antenna 16 and the second antenna 17 are transferred through the feeder line 22. Although not shown in FIG. 5, the first antenna 16 and the second antenna 17 are installed in a feeding section of a solder land, etc., and are connected through the feeding section to the matching elements 18 and 19 and the feeder line 22. Each antenna is connected at an opposite end to the open section 20, and the open section 20 is formed of a solder land, etc. It is also proper to provide the open section 20 with a top hat conductor part to increase the load capacity, thereby putting the first antenna 16 and the second antenna 17 into a wide band. At this time, the top hat conductor is formed of a solder land, a board pattern, etc. As the antenna is connected to the open section, emission and reception of a radio wave as the antenna are accomplished.

The antenna apparatus 15 shown in FIG. 5 is an antenna apparatus having two close and different resonance frequencies of the first antenna 16 and the second antenna 17.

FIG. 6 shows an antenna apparatus 15 including three antennas having close and different resonance frequencies. Numeral 23 denotes a third antenna, which may be a pattern antenna on a board, may be a helical antenna, or may be any other type of antenna. The third antenna 23 has a resonance frequency different from and close to that of a first antenna 16 and a second antenna 17. The third antenna 23 is also connected through a feeding section to matching elements 18 and 19 and a feeder line 22 and is connected to an open section 20 made of a solder land, etc. Like the first antenna 16 and the second antenna 17, the third antenna 23 is connected to the same feeder line 22, a common signal line is supplied to the third antenna 23, and the received signals are transferred through the common feeder line 22. The antenna apparatus shown in FIG. 6 is an antenna apparatus having three close resonance frequencies.

Next, providing a wide band will be discussed.

Figure 7:
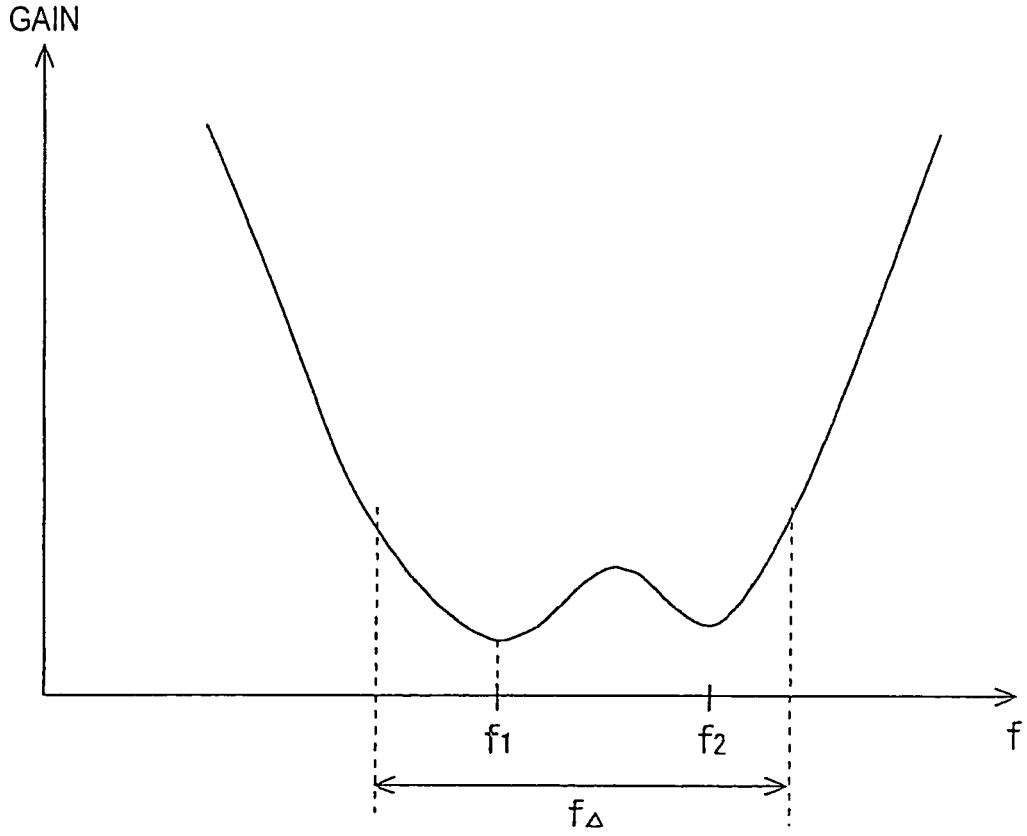
FIG. 7 is a frequency characteristic drawing of the antenna apparatus (FIG. 5) in the first embodiment of the invention.
Figure 8:
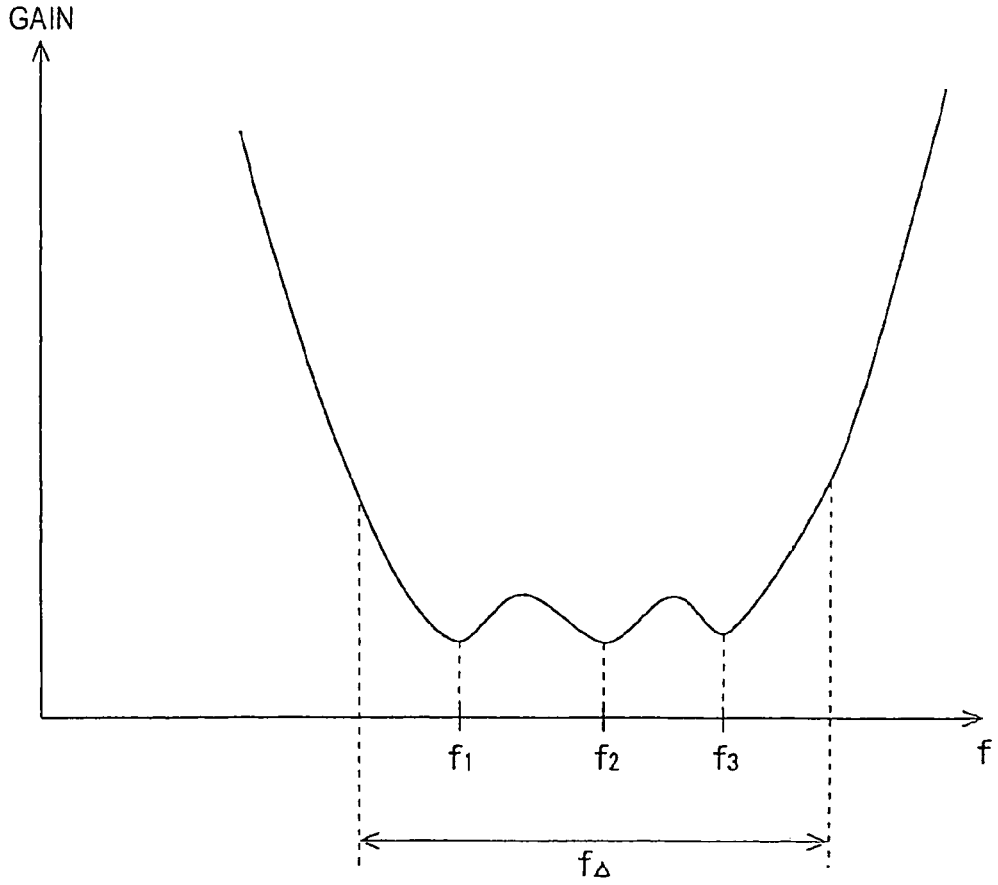
FIG. 8 is a frequency characteristic drawing of the antenna apparatus (FIG. 6) in the first embodiment of the invention.
Figure 9:
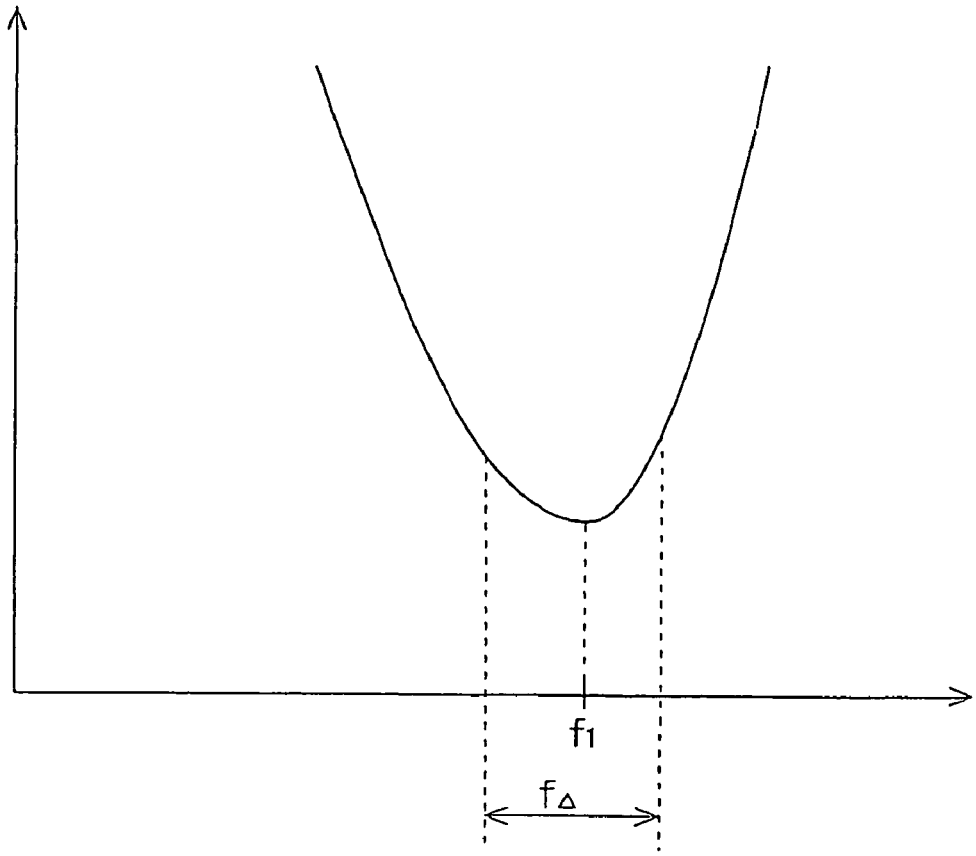
FIG. 9 is a frequency characteristic drawing of an antenna apparatus having a single antenna.

FIGS. 7 and 8 are frequency characteristic drawings of the antenna apparatus in the first embodiment of the invention. FIG. 9 is a frequency characteristic drawing of an antenna apparatus having a single antenna. In the figures, the horizontal axis indicates frequencies and the vertical axis indicates gains. FIG. 7 shows the frequency characteristic of the antenna apparatus including the first antenna 16 and the second antenna 17 shown in FIG. 5, and FIG. 8 shows the frequency characteristic of the antenna apparatus also including the third antenna 23 shown in FIG. 6.

f1 is the resonance frequency of the first antenna 16, f2 is the resonance frequency of the second antenna 17, and f3 is the resonance frequency of the third antenna 23. fΔ is the frequency band of transmission and reception; and the frequency band in which necessary gain can be provided is shown. That is, the signals contained in the band fΔ can be transmitted and received. On the other hand, FIG. 9 shows the frequency characteristic of an antenna apparatus having a single antenna. As is clear from fΔ in FIG. 9, the single antenna would have a narrow band and be insufficient if a wide band is required as in communications at a high transmission rate. In contrast, it is seen that fΔ is a sufficiently wide band in the frequency characteristic of the antenna apparatus in the first embodiment of the invention shown in FIGS. 7 and 8. The two or three close and different resonance frequencies are smoothly concatenated, whereby the band fΔ is enlarged. As seen in FIGS. 7 and 8, since the band fΔ is enlarged as the close and different resonance frequencies are concatenated, if the resonance frequencies f1, f2, and f3 are too distant from each other, the peak interval of f1, f2, f3 becomes too large and an area with a very low gain occurs between the peaks. In this case, the band fΔ cannot be enlarged because a state in which transmission and reception are not sufficient is entered. In contrast, if f1, f2, and f3 are too close to each other, even if the resonance frequencies are concatenated, the band fΔ is still narrow and the target wide band cannot be provided. Thus, it is necessary to optimally determine the resonance frequencies of the antennas from the relationship between the target band and gain. If a very wide band is required, a number of antennas can be connected in addition to the third antenna for providing the very wide band.

The signals contained in the thus enlarged band fΔ are all transmitted through the same feeder line 22, so that it is made possible to receive and demodulate all data contained in a wide band area. Accordingly, transmission and reception in a very wide band required in data communications, etc., at a high transmission rate, etc., are accomplished.

Each of the first antenna 16, the second antenna 17, and the third antenna 23 may be a helical antenna, a pattern antenna, or any other type of antenna. However, preferably the first antenna as the main antenna is a helical antenna and other antennas are pattern antennas from the viewpoints of the cost, ease of manufacturing, miniaturization, etc. Particularly at high frequencies of 800 MHz, 900 MHz, 1.8 GHz, etc., in mobile telephones, miniaturization of an antenna apparatus is promoted as a helical antenna and pattern antennas are used. At this time, while miniaturization of an electronic apparatus incorporating the antenna apparatus is maintained, wide-band transmission and reception can be accomplished.

For example, if reception in a dual band of 900 MHz and 1.8 GHz is required as in GSM of a mobile telephone or the like, two routes of antennas are provided, so that an antenna apparatus with each antenna in a wide band can be realized.

Figure 10:
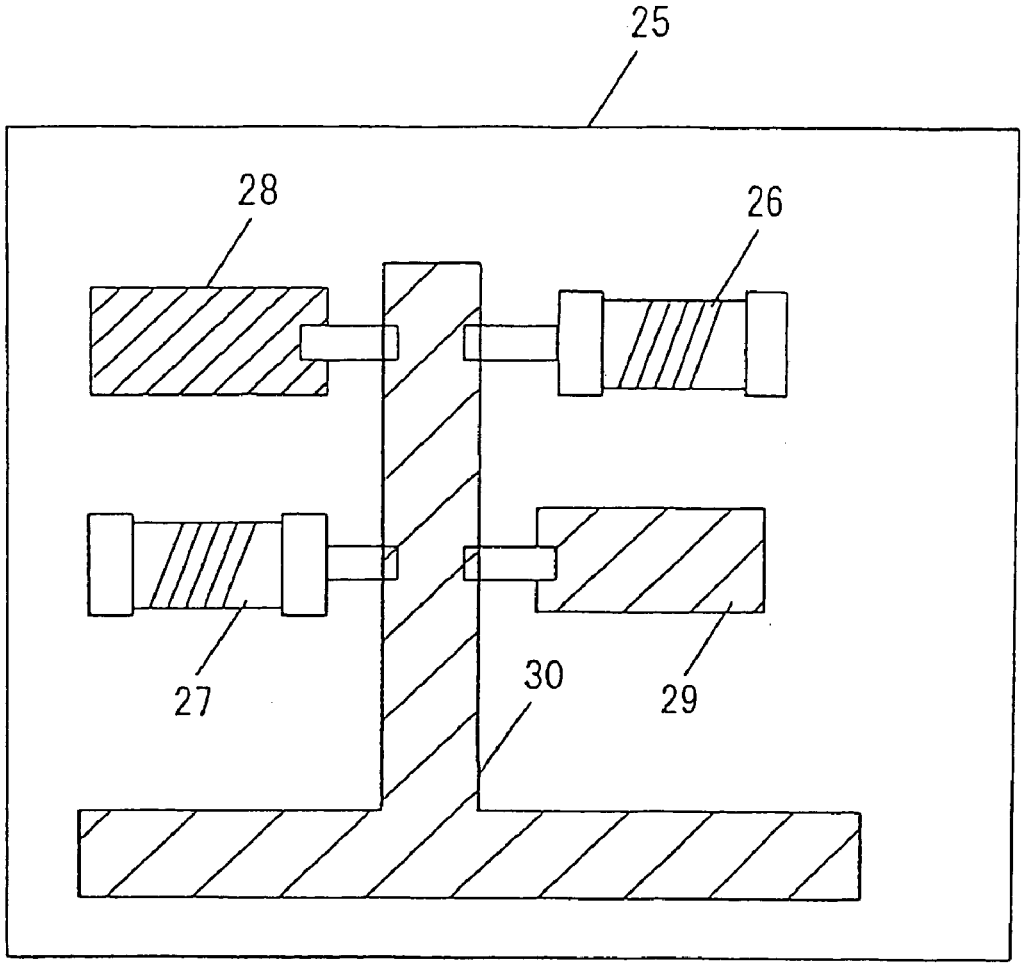
FIG. 10 is a drawing to show the configuration of a dual-band antenna apparatus in the first embodiment of the invention.

FIG. 10 is a drawing to show the configuration of a dual-band antenna apparatus in the first embodiment of the invention. For example, an antenna route for transmitting and receiving in a 900-MHz band and an antenna route for transmitting and receiving in a 1.8-GHz band are installed as a dual band.

Numeral 25 denotes an antenna apparatus, numeral 26 denotes a first helical antenna, numeral 28 denotes a first pattern antenna, numeral 27 denotes a second helical antenna, numeral 29 denotes a second pattern antenna, and numeral 30 denotes a feeder line. All antennas are connected to the common feeder line 30 through matching elements, etc. Terminal sections at opposite ends are connected to separate open sections. The first helical antenna 26 and the first pattern antenna 28 form any desired frequency band (for example, 900-MHz band), and the second helical antenna 27 and the second pattern antenna 29 form another frequency band (for example, 1.8-GHz band). The resonance frequencies of the first helical antenna 26 and the first pattern antenna 28 are close to and different from each other and are smoothly concatenated, whereby fΔ of a wide band as previously described with reference to FIG. 8 is formed. On the other hand, the resonance frequencies of the second helical antenna 27 and the second pattern antenna 29 are also close to and different from each other and are smoothly concatenated, whereby fΔ of a wide band is formed. At this time, the transmission-reception frequency produced through the first helical antenna 26 and the first pattern antenna 28 differs from that produced through the second helical antenna 27 and the second pattern antenna 29, so that dual-band communications at 900 MHz and 1.8 GHz or the like, for example, are accomplished. Further, the frequency bands are made wide as previously described with reference to FIG. 8, etc., and therefore wide-band communications required at a high transmission rate, etc., are accomplished.

In FIG. 10, one helical antenna and one pattern antenna are used in combination for communications at any desired frequency band to provide a wide band. However, helical antennas or pattern antennas may be used as all antennas or three or more antennas may be used in combination to provide a wide band.

For a triple band, etc., a combination of antennas having the resonance frequency required for the purpose and its close resonance frequency can be added.

Next, the experimental results on the antenna apparatus will be discussed.

Figure 11A:
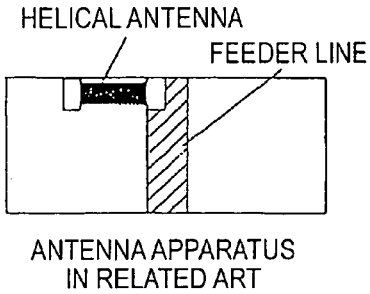
FIG. 11A is a schematic drawing of an antenna apparatus in a related art.
Figure 11B:
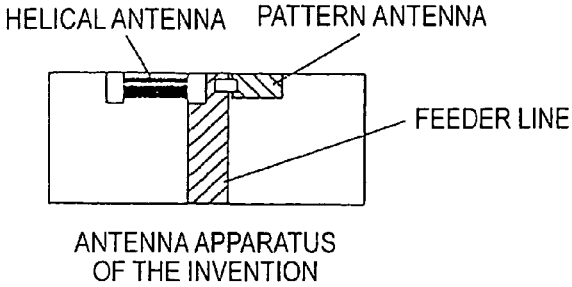
FIG. 11B is a schematic drawing of the antenna apparatus of the invention.
Figure 11C:
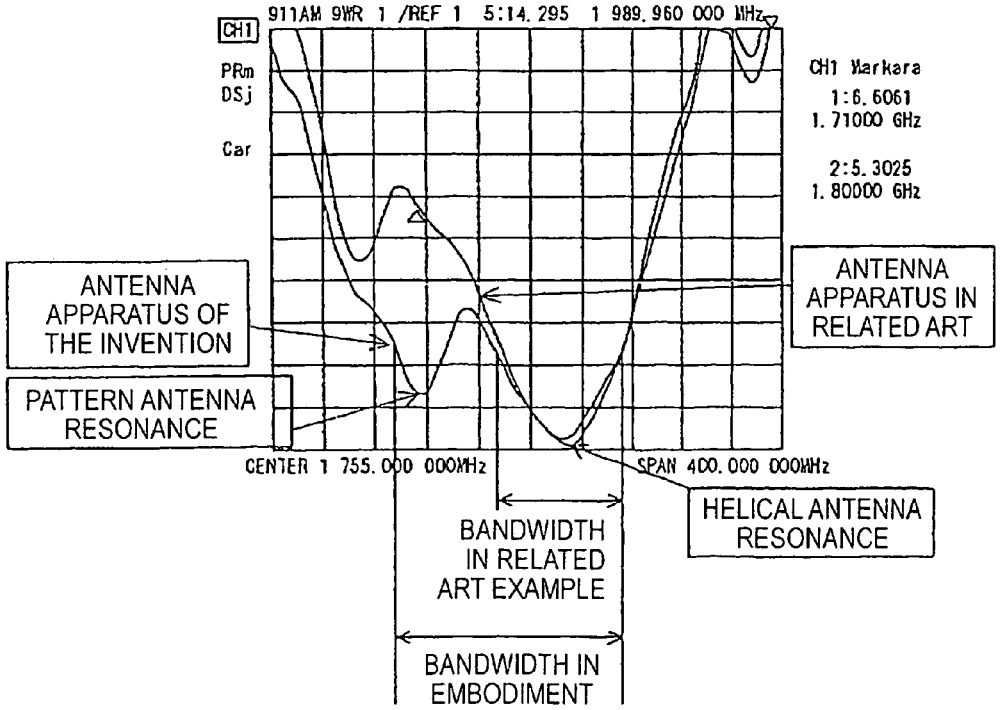
FIG. 11C is a frequency characteristic drawing.

FIGS. 11A–11C show the experimental results of frequency characteristic comparison between an antenna apparatus in a related art and the antenna apparatus of the invention. FIG. 11A is a schematic drawing of the antenna apparatus in the related art, FIG. 11B is a schematic drawing of the antenna apparatus of the invention, and FIG. 11C is a frequency characteristic drawing.

The antenna apparatus in the related art includes a single helical antenna (or a single pattern antenna or any other type of single antenna) and has a single resonance frequency, as shown in FIG. 11A. In contrast, the antenna apparatus of the invention in FIG. 11B has a pattern antenna connected to a common feeder line in addition to a helical antenna. The helical antenna and the pattern antenna have close and different resonance frequencies. As seen in FIG. 11C to represent the experimental results by the frequency characteristics, the bandwidth of the antenna apparatus of the invention is very large as compared with the bandwidth of the antenna apparatus in the related art. According to the experimental results, the bandwidth is enlarged almost to 1.8 to 2 times the bandwidth of the antenna apparatus in the related art. Thus, a plurality of antennas having close and different resonance frequencies are connected to a common feeder line as in the invention, whereby the transmission-reception bandwidth can be enlarged effectively. In the experiments, the antenna apparatus of the invention uses two antennas. However, to use three or more antennas, the band is further enlarged and the gain is provided more easily. A helical antenna and a pattern antenna are used as the antennas, so that the antenna apparatus can be held sufficiently small-sized as compared with the antenna apparatus in the related art.

FIGS. 12A–12E show the experimental results using two antennas in a GSM band (900 MHz) and a DCS band (1.8 GHz). FIG. 12A is a schematic drawing of an antenna apparatus covering the GSM band; FIG. 12B is a schematic drawing of an antenna apparatus covering the DCS band; FIG. 12C is a frequency characteristic drawing of the experimental results in the GSM band; FIG. 12D is a frequency characteristic drawing of the experimental results in the DCS band; and FIG. 12E is a drawing to show the gain results. A helical antenna and a pattern antenna are connected to a common feeder line and have close and different resonance frequencies, as shown in FIGS. 12A and 12B. Resonance of the helical antenna and that of the pattern antenna occur closely and are concatenated smoothly, resulting in enlargement of the transmission-reception band, as shown in FIGS. 12C and 12D. f1 is the resonance frequency difference between the helical antenna and the pattern antenna in the GSM band, and f2 is the resonance frequency difference between the pattern antenna and the helical antenna in the DCS band. Since the differences f1 and f2 affect the transmission-reception frequency bands, if f1 and f2 are increased, the frequency bands are enlarged. However, the larger the resonance frequency difference, the larger the drop of the gain between the peaks of the resonance frequencies, resulting in a decrease in the gain as a whole. Thus, an adjustment needs to be made from the balance between the gain and the bandwidth. The resonance frequencies of the antennas of each antenna apparatus need to be determined so that the balance between the gain and the bandwidth becomes optimal.

FIG. 12E shows the gain measurement results at two frequencies when f1 and f2 are changed. As seen in the figure, if f1 and f2 change to an extent, the gain is almost maintained. Further, the necessary gain is about −2.0 dB in the GSM band and therefore the necessary gain is almost accomplished. Further, the frequency band is enlarged and a sufficient balance between the gain and the bandwidth is secured. Accordingly, wide-band transmission to require a high transmission rate in the GSM band is achieved.

Likewise, the result of securing the balance between the frequency band and the gain even in the DCS band is obtained, and the antenna apparatus makes possible wide-band transmission using the DCS band.

The experimental results have been described by taking the GSM band and the DCS band as an example. However, the invention is also applied to other bands and frequency band communications are not limited to GSM or DCS, needless to say.

The antenna apparatus each using helical and pattern antennas in combination have been described. However, any other type of antenna may be used and an antenna apparatus may be implemented using three or more antennas. It is also proper to connect both an antenna group covering the GSM band and an antenna group covering the DCS band to the same feeder line for providing compatibility with a dual band and accomplish wide-band transmission in each of the GSM and DCS bands. For such a dual band, it is desirable that connection should be made starting at the antenna group covering the higher frequency band with the feeder line as the reference. In doing so, it is confirmed that the gain is enhanced from the experimental results although not shown in the figure.

Since the helical antenna ensures the current density making the most of an image current occurring on the ground, it is desirable that the ground should be ensured.

It is also proper to connect a top hat conductor to an open terminal of the helical antenna for enhancing the load capacity to further promote providing a wide band.

The antenna apparatus as described above makes possible transmission and reception in a wide band required in radio communications, etc., at a high transmission rate. As helical antennas are used as some or all of the antennas of the antenna apparatus, the antenna apparatus can also be held small-sized.

Second Embodiment

Figure 13:
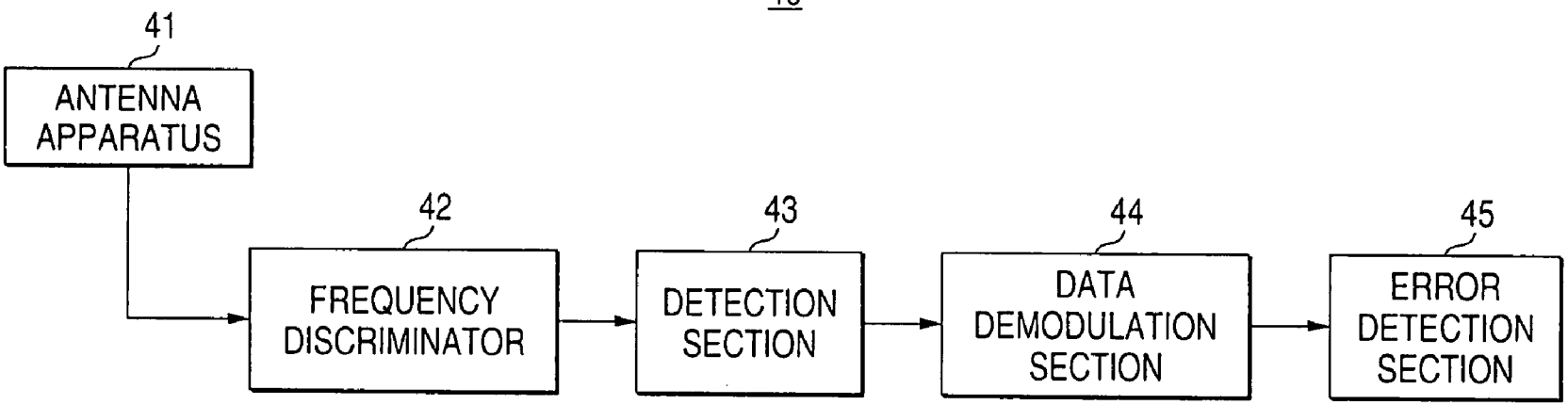
FIG. 13 is a block diagram of a reception apparatus in a second embodiment of the invention.

FIG. 13 is a block diagram of a reception apparatus in a second embodiment of the invention. Numeral 40 denotes a reception apparatus, numeral 41 denotes an antenna apparatus, numeral 42 denotes a frequency discriminator, numeral 43 denotes a detection section, numeral 44 denotes a data demodulation section, and numeral 45 denotes an error detection section. The error detection section may be replaced with an error correction section for also making an error correction.

First, the operation of the reception apparatus 40 is as follows.

A radio wave signal is received at the antenna apparatus 41 and is transmitted to the frequency discriminator 42. At this time, wide-band reception is accomplished in the antenna apparatus 41 as previously described in the first embodiment. Thus, it is appropriate for the case where data communications are conducted over a wide band at a high transmission rate, etc. All necessary bands can be received at the antenna apparatus capable of performing wide-band reception and the received data can be detected and demodulated in batch in the antenna apparatus, so that a redundant circuit configuration is not necessary and a processing procedure of reconstructing demodulated data, etc., becomes unnecessary.

The frequency discriminator 42 takes out the signal at the frequency to be received. The signal provided by the frequency discriminator 42 is transmitted to the detection section 43, which then extracts a necessary signal waveform from the carrier by performing synchronous detection, delay detection, etc. The signal extracted by the detection section 43 is transmitted to the data demodulation section 44, which then demodulates the modulated data. For example, phase-modulated digital data is demodulated into the original digital data by demapping on an orthogonal plane. Alternatively, frequency-modulated digital data is demodulated into a binary signal of a string of "1" and "0" from the modulated frequency difference. The data provided by the data demodulation section 44 is subjected to error detection by the error detection section 45 as required. For example, cyclic redundancy check (CRC), parity check, or the like is made for error detection. Specifically, a match is detected between the parity code added in the transmitting party and even parity, odd parity, etc., of the actual data provided by the data demodulation section 44. Alternatively, the data provided by the data demodulation section 44 is divided according to a generating polynomial and the remainder is checked to detect an error. If an error is detected, processing of making a request to resend data, etc., is performed.

Alternatively, an error correction may be made by Viterbi decoding or Reed-Solomon decoding. In this case, the detected error can also be corrected and consequently, a request to resend data, etc., becomes unnecessary and the reception performance is enhanced.

Preferably, a low-noise amplifier is installed at a later stage of the antenna apparatus or a down conversion section is installed as required. In radio communications at a very high frequency, detection and data demodulation may be difficult to perform at the high frequency and thus it may be proper to decrease the frequency once into an intermediate frequency by executing down conversion.

The reception apparatus 40 as described above makes it possible to accomplish reception in data communications at a high transmission rate requiring a wide band with a small circuit configuration.

Third Embodiment

An antenna module having two antennas of a first antenna and a second antenna connected for realizing multiple resonance, a wide band, and miniaturization will be discussed with FIGS. 14 to 18.

Figure 14:
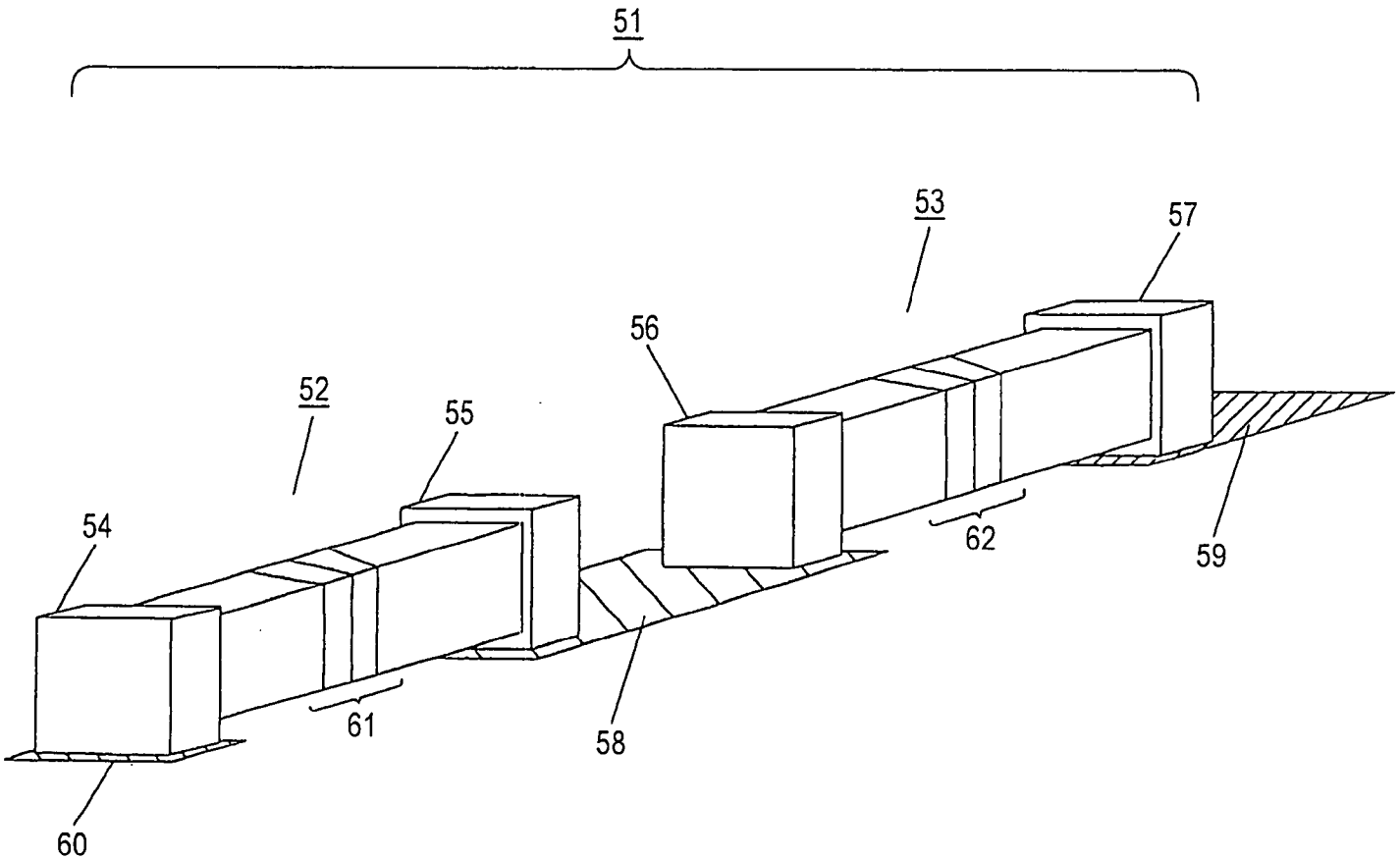
FIG. 14 is a perspective view of an antenna module in a third embodiment of the invention.
Figure 15:
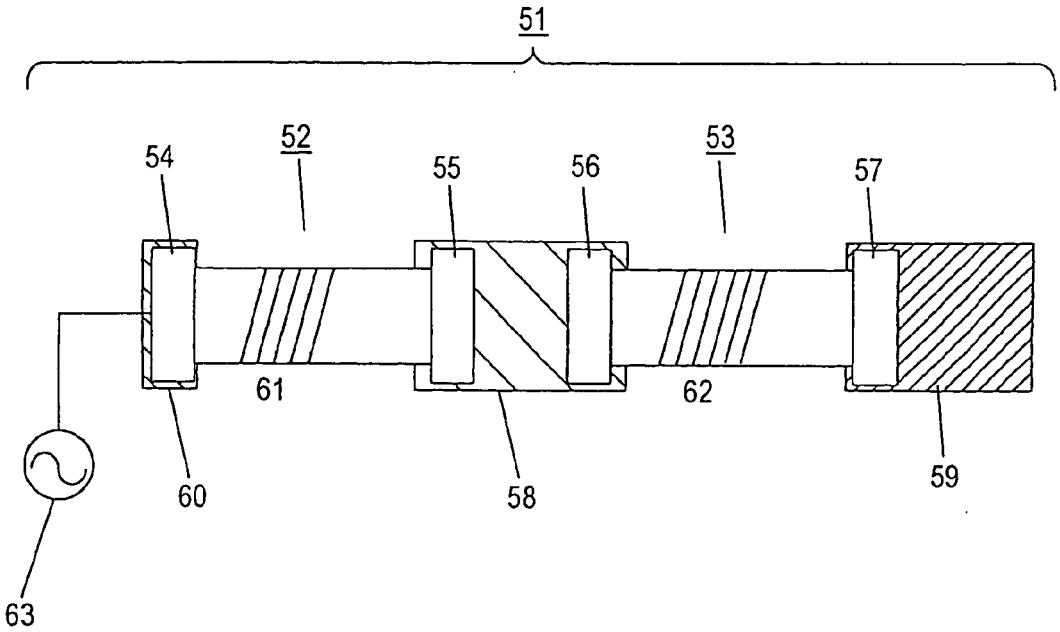
FIG. 15 is a drawing to show the configuration of the antenna module in the third embodiment of the invention.
Figure 16:
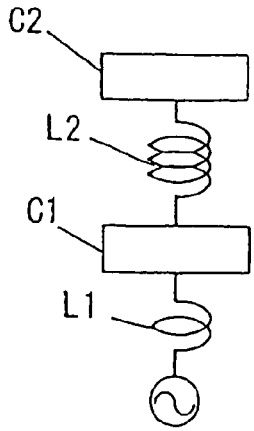
FIG. 16 is an equivalent circuit diagram of the antenna module shown in FIG. 14.
Figure 17:
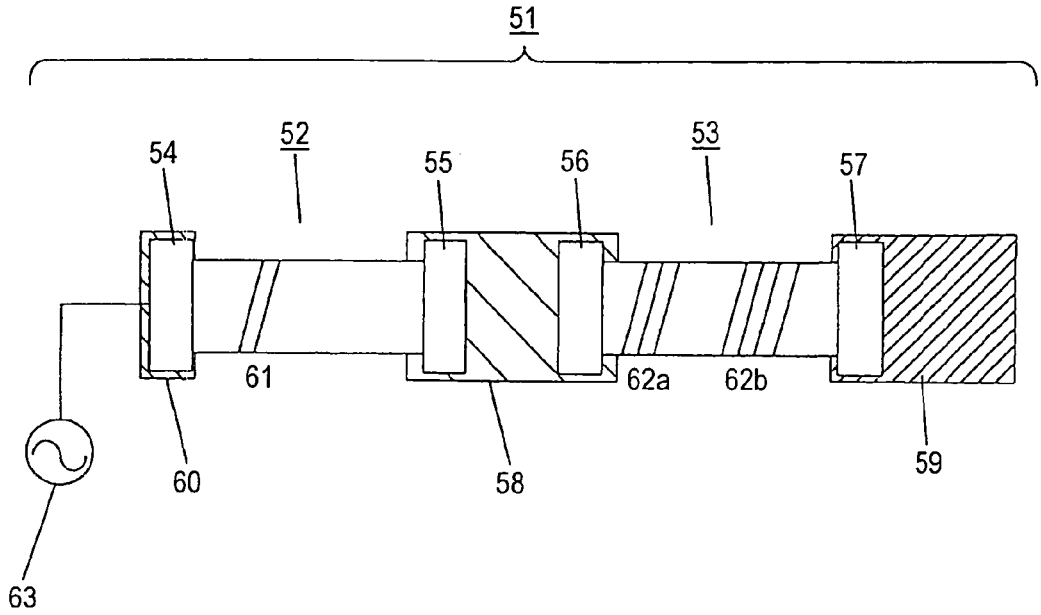
FIG. 17 is a drawing to show the configuration of an antenna module in the third embodiment of the invention.
Figure 18:
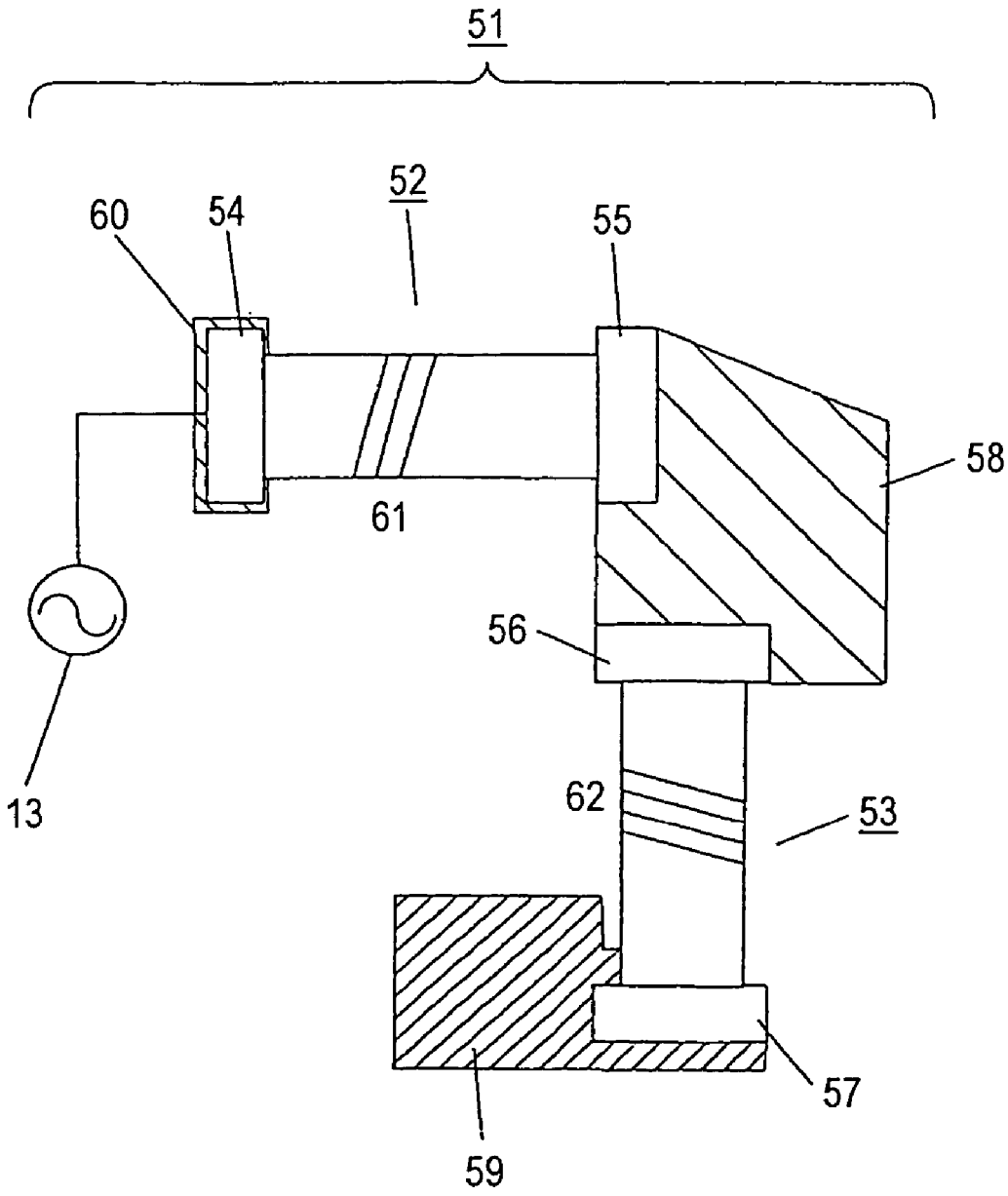
FIG. 18 is a drawing to show the configuration of an antenna module in the third embodiment of the invention.

FIG. 14 is a perspective view of an antenna module in a third embodiment of the invention, FIGS. 15, 17, and 18 are drawings to show the configurations of antenna modules in the third embodiment of the invention, and FIG. 16 is an equivalent circuit diagram of the antenna module shown in FIG. 14.

In the description, helical antennas are used, but any other type of pattern antenna can also be used.

Numeral 51 denotes an antenna module and numerals 52 and 53 denote helical antennas. The helical antenna 52 is a first antenna and the helical antenna 53 is a second antenna. Numerals 54, 55, 56, and 57 denote terminal sections, numeral 58 denotes a connection conductor, numeral 59 denotes an additional conductor, numeral 60 denotes a feeding section, numerals 61 and 62 denote spiral grooves, and numeral 63 denotes a feeding point. L1 and L2 denote inductor components and C1 and C2 denote capacitance components.

First, the helical antennas 52 and 53 will be discussed.

The helical antenna 52, 53 is manufactured as follows. A conductive film is formed on the surface of a base body, a pair of terminal sections is formed on the base body, and a part of the conductive film is trimmed with a laser, etc., to form the spiral grooves 61 and 62.

The base body is formed by pressing, extruding, etc., a dielectric, an insulator such as ceramic material of alumina or mainly consisting of alumina, or the like. As a component material of the base body, ceramic material of forsterite, magnesium titanate base, calcium titanate base, zirconia tin titanium base, barium titanate base, lead calcium titanium base, etc., may be used and resin material of epoxy resin, etc., may be used. In the first embodiment, ceramic material of alumina or mainly consisting of alumina is used from the viewpoint of strength, insulation properties, or ease of working. Further, one or more conductive films made of a conductive material of copper, silver, gold, nickel, etc., are deposited on the whole of the base body to form a surface having conductivity. Plating, vapor deposition, sputtering, paste, etc., is used for the conductive film.

The terminal sections 54 and 55, 56 and 57 are formed on opposite ends of the base body. At least one of parts formed by thin films of conductive plated film, evaporated film, sputtered film, etc., applying sliver paste, etc., and baking, etc., and the like is used.

The base body may have a cross section of the same size as that of the terminal section 54, 55, 56, 57. Further, it may undergo gradation and may have a smaller cross-sectional area than the terminal section 54, 55, 56, 57. As the outer periphery of the base body is gradated, it is possible for the base body to have a distance from the surface of the antenna installation board at the installing time, and it is possible to prevent degradation of the characteristics. At the time, the base body may have a partial or fully gradated face. If the base body has the fully gradated face, which face is to be brought into contact with an electronic board need not be taken into consideration at the installing time, and the cost at the installing time can be decreased.

The base body may have chamfered corners. As the chamfers are provided, a breakage of the base body is prevented, the conductive film is prevented from thinning, or damage to the spiral groove 61, 62 is prevented.

The base body and the terminal sections may be separately formed and later bonded, etc., so that they are put into one piece, or may be previously formed in one piece. The base body may be shaped like a polygon such as a triangle, a pentagon or a circular column rather than a rectangle of a quadrangle. If the base body is shaped like a circular column, corners are eliminated, so that shock resistance is enhanced and formation of the spiral groove 61, 62 is facilitated.

The surface of the base body having conductivity is spirally cut by trimming with a laser, etc., to form the spiral groove 61, 62, and an inductor component is provided. The inductor component formed by the spiral groove 61, 62 is electrically connected to the terminal section; and, therefore, the inductor component is electrically connected. The helical antenna 52, 53 may be formed by winding a conductor wire of a copper wire, etc., around the base body rather than by being provided with the spiral groove formed by laser trimming.

Preferably, the outer periphery of the helical antenna 52, 53 is covered with a protective film avoiding the terminal sections 54 and 55, 56 and 57 to enhance the durability of the helical antenna 52, 53.

The helical antenna 52, 53 may be a $\lambda/4$ type antenna or may be a $\lambda/2$ type antenna. To further promote miniaturization, the former is often used, in which case a transmission-reception gain is secured using an image current occurring on the ground existing in the proximity of the helical antenna 52, 53.

The helical antennas 52 and 53 are placed roughly in the same line and thus the area in the width direction can be made small. Helical antennas are adopted as the antennas to shorten the length of each antenna, so that efficient installation in the length direction is conducted and the area can be decreased as compared with the case where the antennas are placed in parallel.

The terminal section 54 is connected to the feeding section 60, the terminal sections 55 and 56 are connected to the connection conductor 58, and the terminal section 57 is connected to the additional conductor 59.

It is preferable that the helical antenna 52 first connected to the feeding section 60 is a helical antenna having a resonance frequency corresponding to a high frequency, and the helical antenna 53 is a helical antenna having a resonance frequency corresponding to a lower frequency than that of the helical antenna 52. That is, the number of rounds of the spiral groove 62 or the conductor wire formed on the helical antenna 53 is larger than the number of rounds of the spiral groove 51 formed on the helical antenna 52. It is made possible to efficiently generate a frequency resonated only with the helical antenna 52 and a frequency resonated according to the resonance condition of the helical antennas 52 and 53, as described later. Of course, the opposite relationship may be adopted. To connect three or more antennas, preferably the resonance frequencies of the antennas are higher in the order as the antennas are close to the feeding section 60. If the antennas are helical antennas, preferably the number of rounds of the trimming groove or the conductor wire increases in the order as the antennas are close to the feeding section 60. Of course, the invention is not limited to this.

Next, the connection conductor 58 and the additional conductor 59 will be discussed.

The connection conductor 58 is a conductor for connecting the helical antennas 52 and 53, namely, the first and second antennas electrically in series, and is formed on the board on which the helical antennas 52 and 53 are installed. At this time, the connection conductor 58 is also used as an installation land of the terminal sections 55 and 56. The connection conductor may be a pattern conductor on the board, a solder face, a land face, a metal face, a metal film, or metal plating. To connect a plurality of antennas in series, the connection conductor 58 is formed between the antennas to make electric connection therebetween.

The additional conductor 59 is formed at the tip of the helical antenna 53, namely, the second antenna as an open end. To connect a plurality of antennas in series, the additional conductor 59 is formed in the terminal section at the extreme tip where the connection conductor connecting the antennas does not exist, on the opposite side to the feeding section 60. The additional conductor 59 may be a pattern conductor on the board, a solder face, a land face, or a metal face like the connection conductor 58, and may be formed also for use as the land face connecting the terminal section 57 to the board.

As shown in FIG. 15, the width of the connection conductor 58 and/or the additional conductor 59 is made equal to or slightly larger than the maximum width of the helical antenna 52, 53, whereby the size of the antenna module 51 in the width direction thereof can be lessened. It may be determined to match the board or electronic apparatus in which the antenna module is installed.

To place the helical antennas 52 and 53 roughly in the same line, the width of the connection conductor 58 and/or the additional conductor 59 is made equal to or slightly larger than the maximum width of the helical antenna 52, 53, whereby a decrease in the installation area in the width direction is further promoted.

The feeding section 60 supplies a signal current to the helical antennas 52 and 53 or transfers signal currents received at the helical antennas 52 and 53 to a reception circuit. The helical antenna 52 is connected to the feeding section 60 and the helical antenna 53 is electrically connected through the connection conductor 58, whereby a signal current is supplied to both the helical antennas 52 and 53. If three or more helical antennas are included, the helical antennas are connected by connection conductors so that a signal current can be supplied to all antennas, of course.

As described above, a plurality of antennas are connected in series through the connection conductors and are placed roughly in the same line, whereby it is made possible to lessen the installation area.

Next, the operation of the antenna module 51 is as follows:

If an inductor component and a capacitance component are connected in series, the resonance frequency is determined according to (expression 1):

$$\omega = \frac{1}{\sqrt{LC}} \qquad \text{[Expression 1]}$$

That is, the resonance frequency is determined by the square root of the product of the inductor component and the capacitance component.

FIG. 16 shows an equivalent circuit of the antenna module including the two helical antennas 52 and 53 shown in FIGS. 14 and 15. L1 is an inductor component produced in the spiral groove 61, C1 is a capacitance component produced mainly in the connection conductor 58, L2 is an inductor component produced in the spiral groove 62, and C2 is a capacitance component produced mainly in the additional conductor 59.

In such an antenna module, first, double resonance of the transmission-reception operation at the resonance frequency corresponding to the resonance condition determined by L1 and C1 and the transmission-reception operation at the resonance frequency corresponding to the resonance condition determined by all of L1, L2, C1, and C2 is realized. For example, a short antenna having the resonance frequency determined by L1 and C1 covers the operating frequency of a mobile telephone, about 1.8 GHz in the DCS standard or the operating frequency of a mobile telephone, about 1.9 GHz in the GSM1900 standard. On the other hand, for example, a long antenna having the resonance frequency determined by L1, L2, C1, and C2 covers the operating frequency of a mobile telephone, 900 MHz in the GSM standard. The antenna module may also cover the frequencies of a radio LAN using 2.4 GHz and 5 GHz, for example.

If three or more antennas are included, an antenna module having three or more resonance frequencies can also be provided, as described later.

In one helical antenna, trimming grooves may be formed apart to provide a plurality of helical sections, thereby producing a plurality of inductor components and a plurality of capacitance components in one helical antenna for further increasing the number of types of resonance frequencies. FIG. 17 shows such a case. The helical antenna 53 is provided with a plurality of helical sections.

Next, efficiently providing an antenna with a wide band will be discussed. The Q value of each antenna is determined according to (expression 2):

$$Q = \frac{1}{R}\sqrt{\frac{L}{C}} \qquad \text{[Expression 2]}$$

As the capacitance component C is increased, the Q value can be decreased. As the Q value is lessened, the frequency characteristic of the input impedance of the antenna can be made flat and it is possible to provide the antenna with a wide band of transmission and reception. That is, the rising and falling edges of the peak in the frequency characteristic become gentle by the action of the capacitance component as the load capacity, resulting in providing the antenna with a wide band.

Both the capacitance component C1 produced by the connection conductor 58 and the capacitance component C2 produced by the additional conductor 59 contribute to forming the capacitance component. Thus, the capacitance component C1 of the connection conductor 58 contributes to providing the antenna with a wide band both at the resonance frequency determined by L1 and C1 and at the resonance frequency determined by L1, L2, C1, and C2. Thus, providing the antenna with a wide band is further promoted.

In contrast, if antennas are connected in parallel and each antenna is formed with a separate additional conductor, the additional conductor contributes separately to providing the antenna with a wide band only as the capacitance component in the antenna. That is, even if the conductor portions for producing the capacitance component of the same area are connected to antennas, if the antennas are connected in parallel, the contribution degree of the conductor area to providing the antenna with a wide band is low. On the other hand, if the antennas are connected in series, all conductor portions each for producing the capacitance component (in the invention, all of the connection conductor for electrically connecting the antennas and the additional conductor) contribute to providing the antenna with a wide band and therefore the contribution degree of the conductor area to providing the antenna with a wide band is high, and the antenna is provided with a wide band efficiently relative to the conductor area.

To connect a plurality of antennas in parallel, as many separate land areas for terminal section connection as the number of terminal sections become necessary and thus the area of the antenna module including the margin area becomes large. On the other hand, to connect a plurality of antennas in series, the land section of each terminal section connected by the connection conductor is also used as the connection conductor and thus a redundant land area and its margin area become unnecessary, so that miniaturization is further promoted.

Thus, in the antenna module having a plurality of antennas connected to the same feeding section to realize multiple resonance, the antennas are connected in series through the connection conductor as in the invention, so that each antenna can be provided with a wide band using the small conductor area. That is, miniaturization of the multiple-resonance, wide-band antenna module can be accomplished easily.

As the antennas are placed roughly in the same line, the merit of the shortening effect of the antenna length using the helical antennas can be further utilized for providing the antenna module 1 narrow in the width direction, and the width of each of the connection conductor 58 and the additional conductor 59 is made equal to or slightly larger than the maximum width of the helical antenna 52, 53, whereby miniaturization in the width direction is accomplished. Thus, an antenna module suited for the case where miniaturization in the width direction rather than in the length direction is required can be provided. The advantage provided by using the helical antennas each with the length shortened is utilized.

A plurality of antennas may be placed in any other mode than the mode in which the antennas are roughly in the same line. The placement may be determined in response to the forms of the installation board, other parts, and the storage cabinet. In this case, miniaturization can also be realized as the conductor for producing the capacitance component is also used for another purpose.

FIG. 18 shows an antenna module having the helical antennas 52 and 53 bent in the connection conductor 58 in placement. The helical antennas 52 and 53 are thus bent in the connection conductor 58 to place the antenna module in the area which is comparatively the same in the width direction and the length direction so as to be compatible with other installation parts, the storage cabinet, and the board shape.

Next, an antenna module having three helical antennas (namely, first antenna, second antenna, and third antenna) will be discussed with FIGS. 19 and 20.

Figure 19:
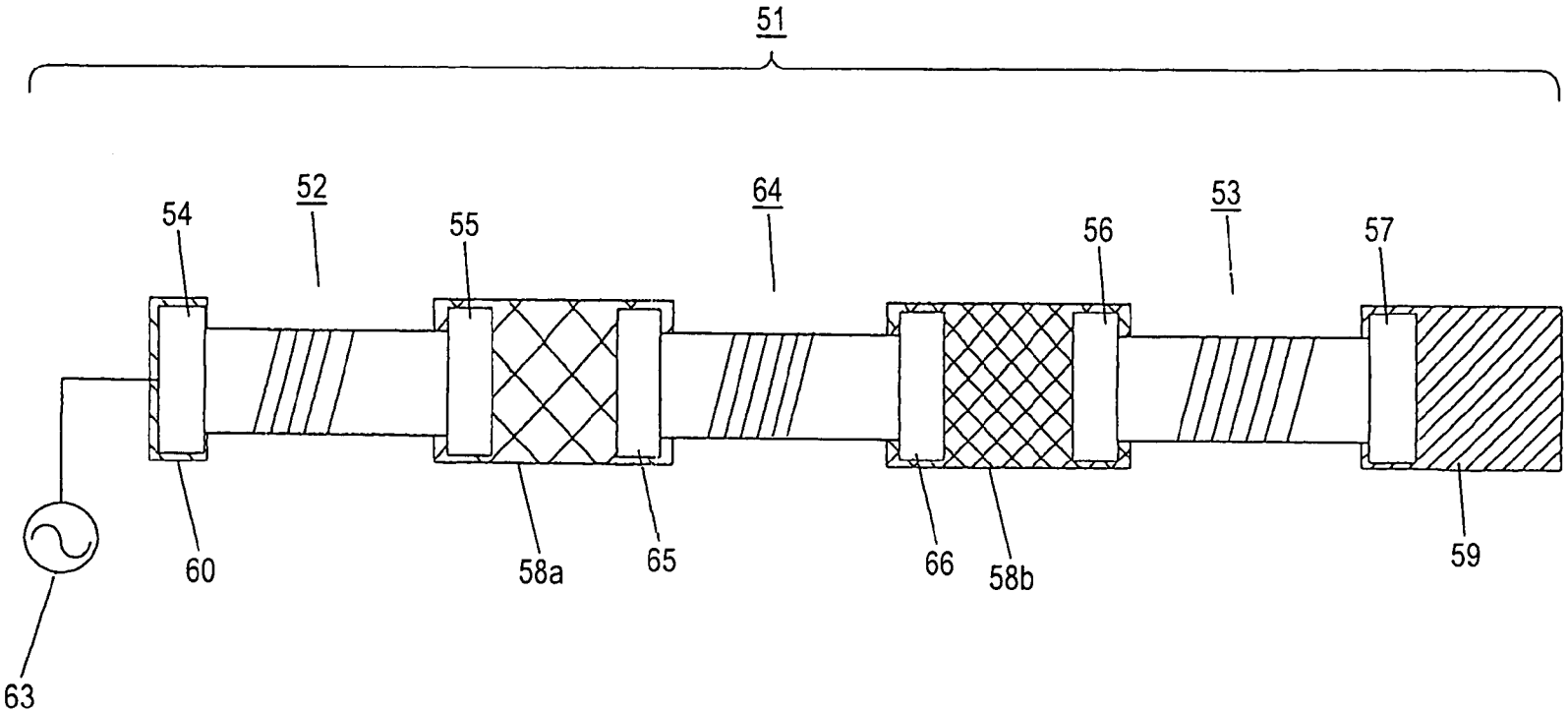
FIG. 19 is a drawing to show the configuration of an antenna module in the third embodiment of the invention.
Figure 20:
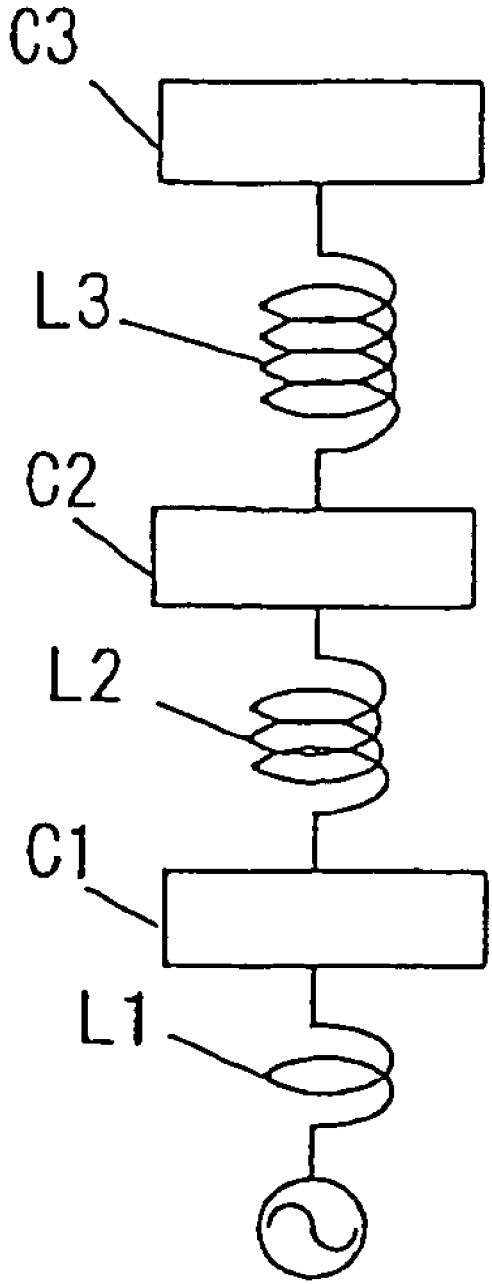
FIG. 20 is an equivalent circuit diagram of the antenna module shown in FIG. 19.

FIG. 19 is a drawing to show the configuration of an antenna module in the first embodiment of the invention, and FIG. 20 is an equivalent circuit diagram of the antenna module shown in FIG. 19.

Numeral 64 denotes a helical antenna as a third antenna. The helical antenna 64 is placed between the helical antennas 52 and 53, namely, the third antenna is placed between the first antenna and the second antenna. Numerals 65 and 66 denote terminal sections. Numerals 58*a* and 58*b* denote connection conductors. The connection conductor 58*a* electrically connects the helical antennas 52 and 64 and the connection conductor 58*b* electrically connects the helical antennas 64 and 53. The connection conductors 58*a* and 58*b* may also be used as solder lands for installing the terminal sections 55 and 65 and the terminal sections 66 and 56. Each of the connection conductors 58*a* and 58*b* is formed of a pattern, a metal face, a solder face, etc. As in the case where the two helical antennas are connected, each of the connection conductors 58*a* and 58*b* and the additional conductor 59 has a width not exceeding or slightly exceeding the maximum width of each helical antenna, so that the area of the antenna module 1 in the width direction thereof can be lessened.

Next, the operation of the antenna module 51 will be discussed with the equivalent circuit shown in FIG. 20.

Since the three helical antennas are placed and are connected by the connection conductors, three inductor components and three capacitance components are connected in series. L1 is the inductor component produced from the helical section of the trimming groove of the helical antenna 52, L2 is the inductor component produced from the helical section of the trimming groove of the helical antenna 64, and L3 is the inductor component produced from the helical section of the trimming groove of the helical antenna 53. C1 is the capacitance component produced from the connection conductor 58*a*, C2 is the capacitance component produced from the connection conductor 58*b*, and C3 is the capacitance component produced from the additional conductor 59.

As is clear from the equivalent circuit, the antenna module operates at three types of resonance frequencies, namely, the highest resonance frequency based on the resonance condition determined by L1 and C1, the intermediate resonance frequency based on the resonance condition determined by L1, L2, C1, and C2, and the lowest resonance frequency based on the resonance condition determined by L1, L2, L3, C1, C2, and C3. Further, the connection conductors 58*a* and 58*b* and the additional conductor 59 are shared as common conductors each for producing the capacitance component, so that the capacitance component required for providing each antenna with a wide band can be increased efficiently. Accordingly, the capacitance component is produced with high efficiency relative to the conductor area as compared with the case where the helical antennas are connected in parallel for multiple resonance and a separate additional conductor is connected to each of the helical antennas. Therefore, the capacitance component produced using the small conductor area is maximized and multiple-resonance and wide-band antenna module can be extremely miniaturized. As the helical antennas 52, 53, and 64 are arranged roughly in the same line, the antenna module becomes suited for the case where it is built in apparatus with low installation allowance in the width direction rather than in the length direction. Of course, if the installation allowance in the length direction is low, the helical antennas 52, 53, and 64 may be bent at the positions of the connection conductors 58*a* and 58*b* for connection.

Next, the experimental result comparison between the antenna module miniaturized and provided with a wide band by connecting the antennas in series through the connection conductors and sharing the connection conductors as the capacitance components and antenna modules in related arts will be discussed.

FIG. 21A is an installation drawing of the antenna module of the invention in a mobile telephone; FIG. 21B is a VSWR drawing of the antenna module of the invention; FIG. 21C is a list to show the gains of the antenna module of the invention; and FIG. 21D is directivity diagrams of the antenna module of the invention. Likewise, FIGS. 22A and 23A are installation drawings of the antenna modules in the related arts in a mobile telephone; FIGS. 22B and 23B are VSWR drawings of the antenna modules in the related arts; FIGS. 22C and 23C are lists to show the gains of the antenna modules in the related arts; and FIGS. 22D and 23D are directivity diagrams of the antenna modules in the related arts.

FIGS. 22A to 22D show the experimental results of the antenna module upsized for enhancing performance in the related art. FIGS. 23A to 23D show the experimental results of the antenna module in the related art having the same degree of area as the antenna module of the invention.

As seen in FIG. 21A, the antenna module of the invention has two helical antennas connected in series through connection conductors for realizing double resonance and a wide band. On the other hand, each of the antenna modules in the related arts has two helical antennas connected in parallel, each antenna being formed with a separate additional conductor for realizing double resonance and a wide band. As is clear from the comparison between FIGS. 21A and 22A, the installation area of the antenna module of the invention is smaller than that of the antenna module in the related art, namely, is about 60% of the installation area of the antenna module in the related art.

As seen in FIGS. 21B and 22B, two frequency peaks exist and double resonance is realized at each peak. Further, almost the same bandwidths are provided in the same VSWR value. Further, as seen in FIGS. 21C and 22C, the antenna module of the invention and the antenna module in the related art are also almost the same in the gain at one frequency. As seen in FIGS. 21D and 22D, the directivity of the antenna module of the invention bares comparison with that of the antenna module in the related art. That is, the performance of the antenna module of the invention that can be miniaturized near 40% bares comparison with that of the antenna module in the related art. The gains of the antenna module of the invention are higher than those of the antenna module in the related art.

As seen in FIGS. 23A to 23D, if miniaturization to the same extent as the invention is conducted, the gains are insufficient and a sufficiently wide band cannot be provided. As seen in FIG. 23B, the frequency bands at positions 1 to 3 of the VSWR value are very small as compared with those in the invention shown in FIG. 21B. It is not sufficient to provide target wide band. The gains are also insufficient.

As is clear from the experimental results, to provide multiple resonance and the gains, directivity, and band equal to or greater than those of the antenna module in the related art, the antenna module of the invention can be miniaturized and further the electronic equipment incorporating the antenna module of the invention can also be miniaturized.

Of course, when an antenna module has antennas connected in parallel and each antenna is formed with a separate additional conductor as in the related art, if the antenna module has an area equal to that of the antenna module of the invention, the antenna module is provided with an insufficiently wide band and the antenna module of the invention is also superior to that antenna module in point of performance.

As described above, it is possible to provide a very small-sized, multiple-resonance antenna module with a wide band.

The antenna modules of the invention have been described with the helical antennas. However, for example, any type of antenna such as a helical antenna of winding type provided by winding a copper wire around a base body, a meander-shaped pattern antenna, or a conductor antenna formed of a conductor may be used with the antenna module of the invention.

Fourth Embodiment

Next, an antenna with a wide band will be discussed with FIGS. 24 to 27.

Figure 24:
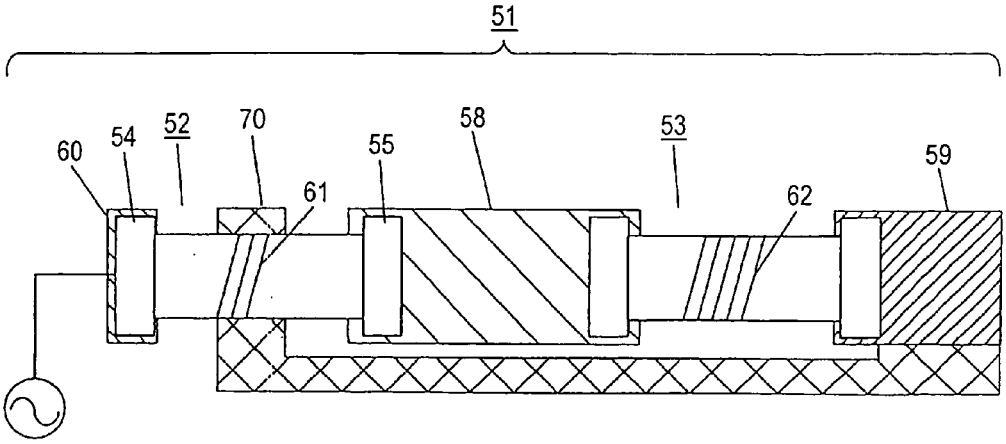
FIG. 24 is a drawing to show the configuration of an antenna module in a fourth embodiment of the invention.
Figure 25:
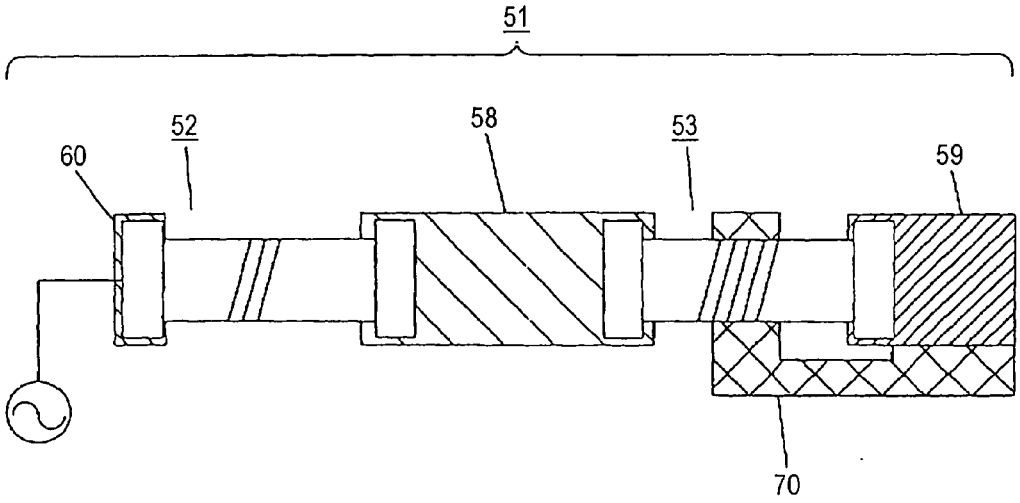
FIG. 25 is a drawing to show the configuration of an antenna module in the fourth embodiment of the invention.
Figure 26:
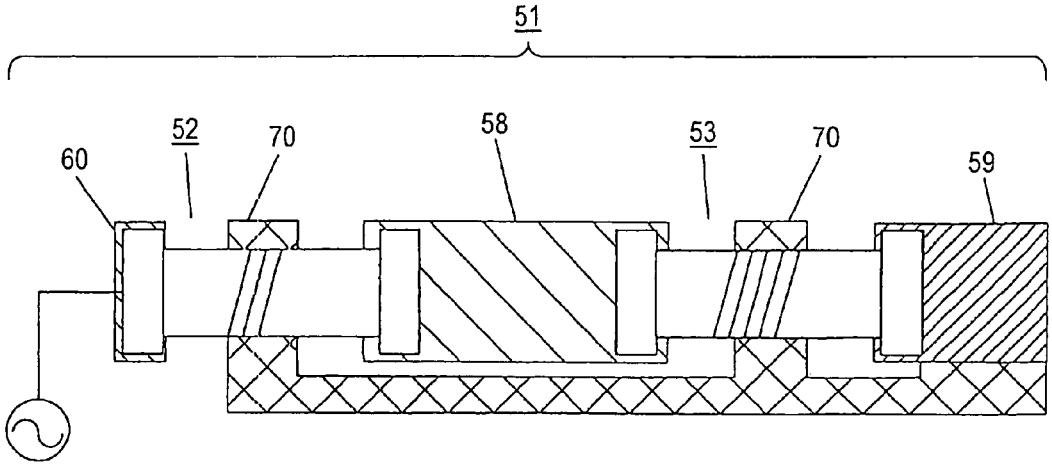
FIG. 26 is a drawing to show the configuration of an antenna module in the fourth embodiment of the invention.
Figure 27:
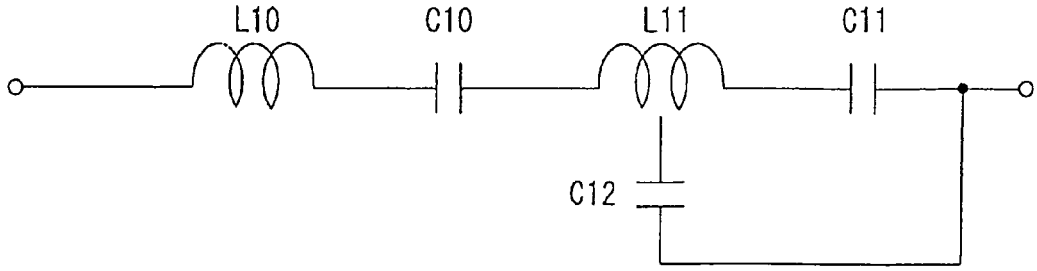
FIG. 27 is an equivalent circuit diagram of the antenna module in FIG. 25.

FIGS. 24 to 26 are drawings to show the configurations of antenna modules in a fourth embodiment of the invention. FIG. 27 is an equivalent circuit diagram of the antenna module in FIG. 25.

Numeral 70 denotes a capacitance conductor. The capacitance conductor 70 is provided on the bottom of either or both of spiral grooves 61 and 62 of helical antennas 52 and 53. For example, in a installation board for installing an antenna module, a conductor for producing a capacitance component, such as solder, board pattern, or metal film, is previously formed in the portion corresponding to the bottom of the spiral groove 61, 62 and then the helical antenna 52, 53 is installed. In FIG. 24, the conductor is formed on the bottom of the spiral groove 61 of the helical antenna 52; in FIG. 25, the conductor is formed on the bottom of the spiral groove 62 of the helical antenna 53; and in FIG. 26, the conductor is formed on the bottoms of both of the spiral grooves 61 and 62 of the helical antennas 52 and 53. The capacitance conductor 70 is extended from an additional conductor 59 and they conduct.

The capacitance conductor is thus placed on the bottom of the spiral groove 61, 62 for producing an inductor component of the helical antenna 52, 53, whereby the spiral groove 61, 62 and the capacitance conductor 70 do not electrically conduct, but are very close to each other and thus are capacitively coupled as in the equivalent circuit diagram of FIG. 27.

C10 is a capacitance component produced mainly in a connection conductor 58, C11 is a capacitance component produced mainly in the additional conductor 59, C12 is a capacitance component produced mainly in the capacitance conductor 70, L10 is an inductor component produced from the spiral groove 61, and L11 is an inductor component produced from the spiral groove 62. As seen in FIG. 27, the capacitance component C12 of the capacitance conductor 70 also contributes to the whole capacitance component as a part thereof.

The whole composite capacitance is represented by the following (expression 3):

$$C = \frac{C10(C11 + C12)}{C10 + C11 + C12} \quad \text{[Expression 3]}$$

As is clear from (expression 3), if the value of C12 becomes larger, the composite capacitance value C becomes larger and as the capacitance value is large, providing the antenna with a wide band is further promoted. This also applies to the antenna modules in FIGS. 25 and 26.

As described above, the antenna can be further provided with a wide band by efficiently utilizing the gap between the helical antenna and the board, occurring when the helical antenna is installed on the board.

The antenna modules of the invention have been described with the helical antennas; however, for example, any type of antenna such as a helical antenna of winding type provided by winding a copper wire around a base body, a meander-shaped pattern antenna, or a conductor antenna formed of a conductor may be used with the antenna module of the invention.

Fifth Embodiment

Figure 28:
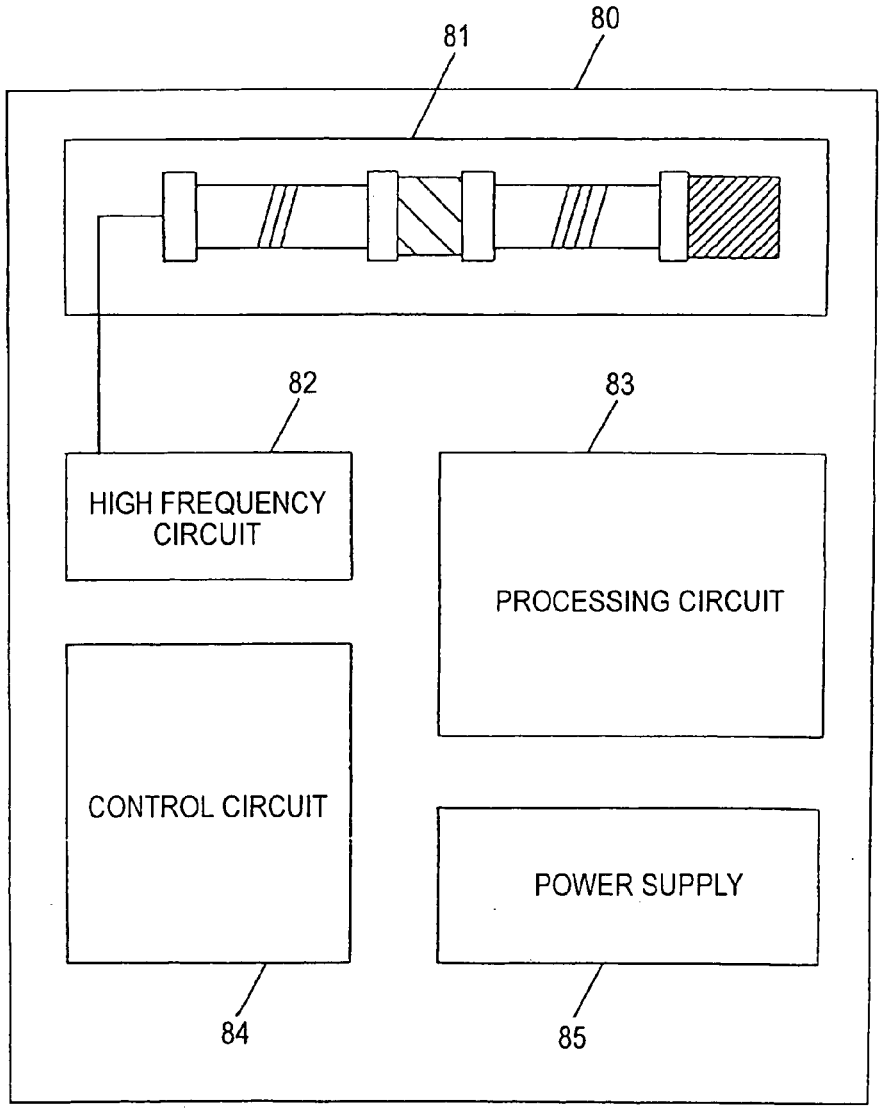
FIG. 28 is a drawing to show the configuration of an electronic apparatus in a fifth embodiment of the invention.

FIG. 28 is a drawing to show the configuration of an electronic apparatus in a third embodiment of the invention. The electronic apparatus shown in FIG. 28 is a notebook personal computer, a portable terminal, a mobile telephone, or the like in which the antenna module in the first or second embodiment is incorporated as a communication antenna.

Numeral 80 denotes a cabinet, numeral 81 denotes an antenna module, numeral 82 denotes a high frequency circuit, numeral 83 denotes a processing circuit, numeral 84 denotes a control circuit, and numeral 85 denotes a power supply.

The cabinet 80 is a cabinet of a mobile telephone or a cabinet of a notebook personal computer, for example. A display section, a memory section, a hard disk, an external storage medium, etc., not shown in FIG. 28 may be included.

The antenna module 81 is the antenna module in the third or fourth embodiment using helical antennas.

The high frequency circuit 82 supplies a high frequency signal current to the antenna module or receives a high frequency signal received at the antenna module 81 and detects the signal. The high frequency circuit 82 includes a power amplifier required in transmission, a low-noise amplifier used in reception, a transmission and reception changeover switch, a noise removal filter, a frequency selection filter, a detection circuit, a mixer, and the like, implemented as discrete devices and integrated circuit.

The processing circuit 83 processes the signal received in the high frequency circuit 82 and reproduces (plays back) the signal and further processes a transmission signal by an LSI, etc. That is, the reception signal is detected, demodulated, and reproduced (played back).

The data provided by demodulating is subjected to error detection as required. For example, cyclic redundancy check (CRC), parity check, or the like is made for error detection. Specifically, a match is detected between the parity code added in the transmitting party and even parity, odd parity, etc., of the actual data provided by the data demodulation section 44. Alternatively, the data provided by demodulating is divided according to a generating polynomial and the remainder is checked to detect an error. If an error is detected, processing of making a request to resend data, etc., is performed.

Alternatively, an error correction may be made by Viterbi decoding or Reed-Solomon decoding. In this case, the detected error can also be corrected and consequently, a request to resend data, etc., becomes unnecessary and the reception performance is enhanced.

The control circuit 34 includes a CPU, etc., for controlling the whole electronic apparatus, and executes time control, synchronous control, processing procedure control for each circuit, and the like as the CPU executes a program, for example. The power supply 85 uses a packed battery, etc., for supplying power to the internal circuitry, display section, etc.

Miniaturization and slimming of a mobile telephone, a portable terminal such as a PDA, a notebook personal computer, etc., as an example of such an electronic apparatus are demanded to the limit. Thus, the antenna module 81 contributes to miniaturization of apparatus because the antenna module 81 is miniaturized as previously described in the first and second embodiments. The mobile telephone needs to process a plurality of resonance frequencies of 900-MHz GSM band, 1.8-GHz DCS band, 1.9-GHz GSM1900 band, etc. The antenna module also needs to be provided with a wide band with an increase in the data amount. For example, reception at 1.8 GHz and reception at 1.9 GHz are made possible in one resonance band, whereby the antenna module 31 including two antennas can cover all of the 900-MHz band, the 1.8-GHz band, and the 1.9-GHz band. Thus, the antennas are connected in series through the connection conductor and the capacitance conductor is efficiently formed for providing the antenna with a wide band, so that it is possible to cover the three frequency bands.

In a radio LAN used with a notebook personal computer, etc., it is also possible to cover both 2.4 GHz and 5 GHz, in which case it is also possible to promote miniaturization.

The antenna module 31 uses the helical antennas and thus can be shorted in the length direction thereof and thus the helical antennas are connected in a line for reducing the area in the width direction and are crammed in the length direction for miniaturizing the apparatus installing the antenna module. Of course, the opposite relationship may be adopted.

Such an electronic apparatus transmits and receives a necessary signal and modulates, demodulates, and reproduces (plays back) the signal, it is made possible to conduct wide-band transmission and reception with multiple resonance, and the electronic apparatus can also be miniaturized.

Sixth Embodiment

Figure 29:
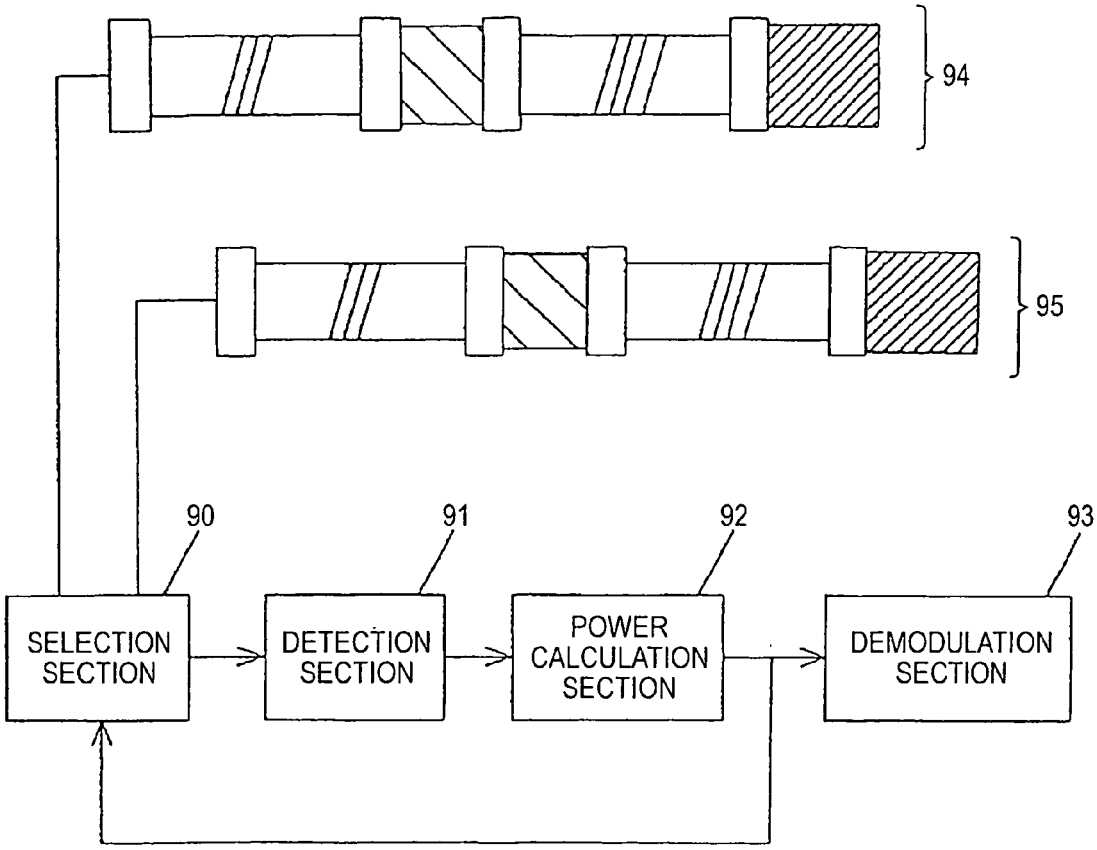
FIG. 29 is a drawing to show the configuration of a diversity apparatus in a sixth embodiment of the invention.

FIG. 29 is a drawing to show the configuration of a diversity apparatus in a sixth embodiment of the invention.

Using two or more antenna modules, the signal with the higher reception power is selected from among the received signals for enhancing the reception performance, or the signals are combined for enhancing the reception performance.

Numeral 90 denotes a selection section, numeral 91 denotes a detection section, numeral 92 denotes a power calculation section, numeral 93 denotes a demodulation section, and numerals 94 and 95 denote antenna modules. Two antenna modules exist.

The power of a signal detected in the detection section 91 is calculated in the power calculation section 92. The calculated power is compared with an arbitrary threshold value and the comparison result is sent to the selection section 90. If the power of the signal is lower than the arbitrary threshold value, the current antenna module 94 or 95 is switched to the other antenna module 95 or 94 for receiving the signal. If the power of the signal is higher than the arbitrary threshold value, the current antenna module is used to continue reception.

Finally, the signal received at the selected antenna module is demodulated by the demodulation section 93 and it is possible to enhance the reception performance.

It is also proper to conduct combined diversity for combining signals to enhance the reception performance rather than selection. In this case, a combining section may be provided in place of the selection section 90.

For example, maximum ratio combining is performed in response to the ratio of power calculated in the power calculation section 42 and demodulation is executed, whereby the C/N ratio (carrier-to-noise ratio) as the cause of the reception performance can be raised for enhancing the reception performance.

Since noise has no correlation, even if simple combining is performed, characteristic improvement of at least about 3 dB is realized.

As described above, selection diversity or combining diversity can be conducted using a plurality of antenna modules for enhancing the reception performance. Even in this case, multiple resonance and a wide band can be realized. As the antenna module is miniaturized, when a plurality of antenna modules are mounted, miniaturization of the electronic apparatus installing the antenna modules is less hindered.

Seventh Embodiment

Figure 35:
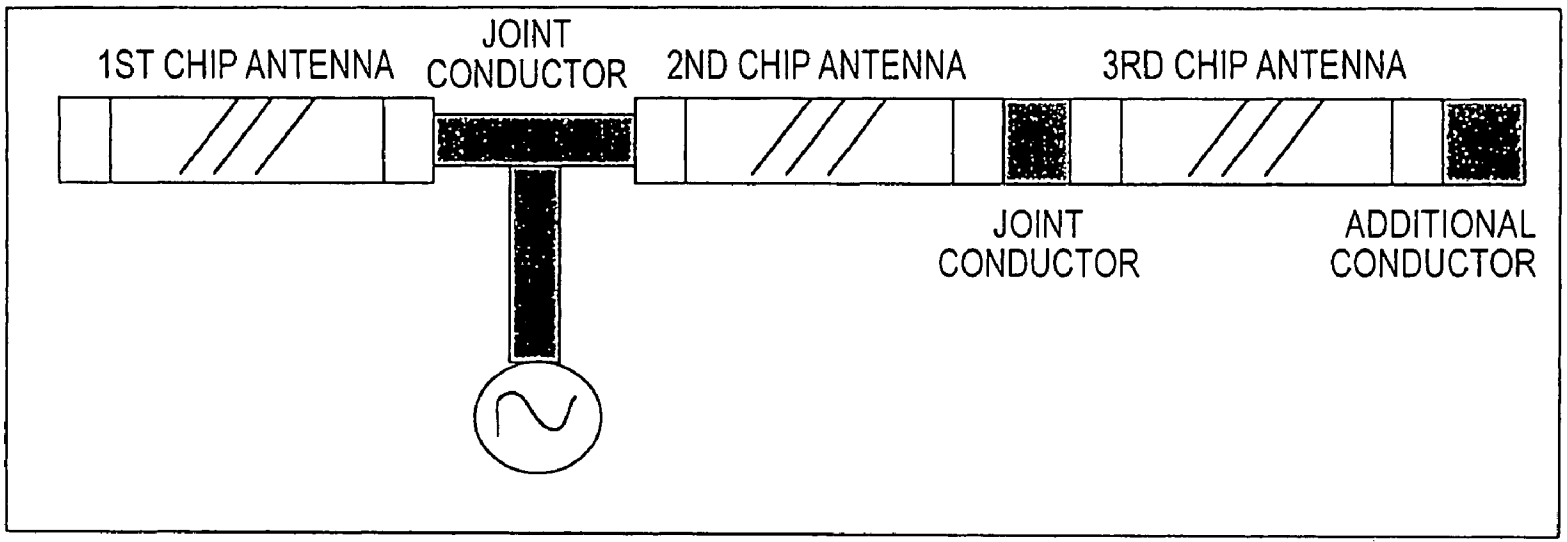
FIG. 35 shows a structure using parallel connection and series connection of chip antennas in combination.

FIG. 35 shows a structure using parallel connection and series connection of chip antennas in combination. First chip antenna is connected in parallel with second chip antenna with a connection conductor as the reference, second and third chip antennas are connected in series through a connection conductor, and the resonance frequency of first chip antenna, the resonance frequency of only second chip antenna, and the resonance frequency when the whole of second and third chip antennas are viewed as one antenna are close to each other.

In this case, second and third chip antennas connected in series share the connection conductor and a wide band is provided at second and third chip antennas in the presence of an additional conductor connected to the tip of third chip antenna. Further, as the two chips are connected in series, double resonance is realized and if the frequencies of the double resonance are brought close to each other, the poles of the frequencies are brought close to each other and are concatenated, so that the antenna module can be provided with a further wide band.

In addition, first chip antenna is connected in parallel with second and third chip antennas through the connection conductor, forming close resonance frequency pole.

Figure 36:
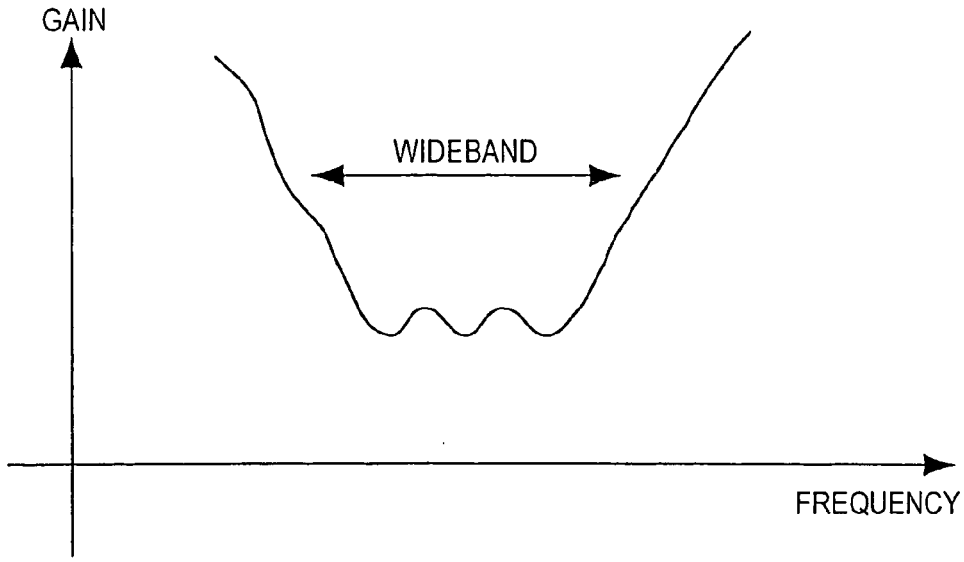
FIG. 36 shows a frequency characteristic of the structure of FIG. 35.
Figure 37:
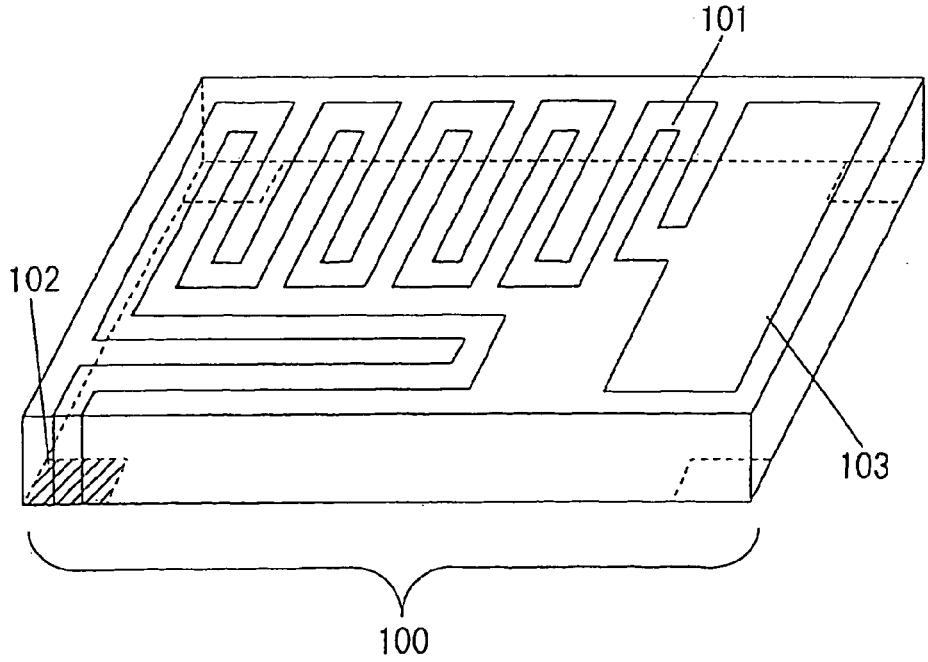
FIG. 37 is a perspective view of an antenna module in a related art.
Figure 38:
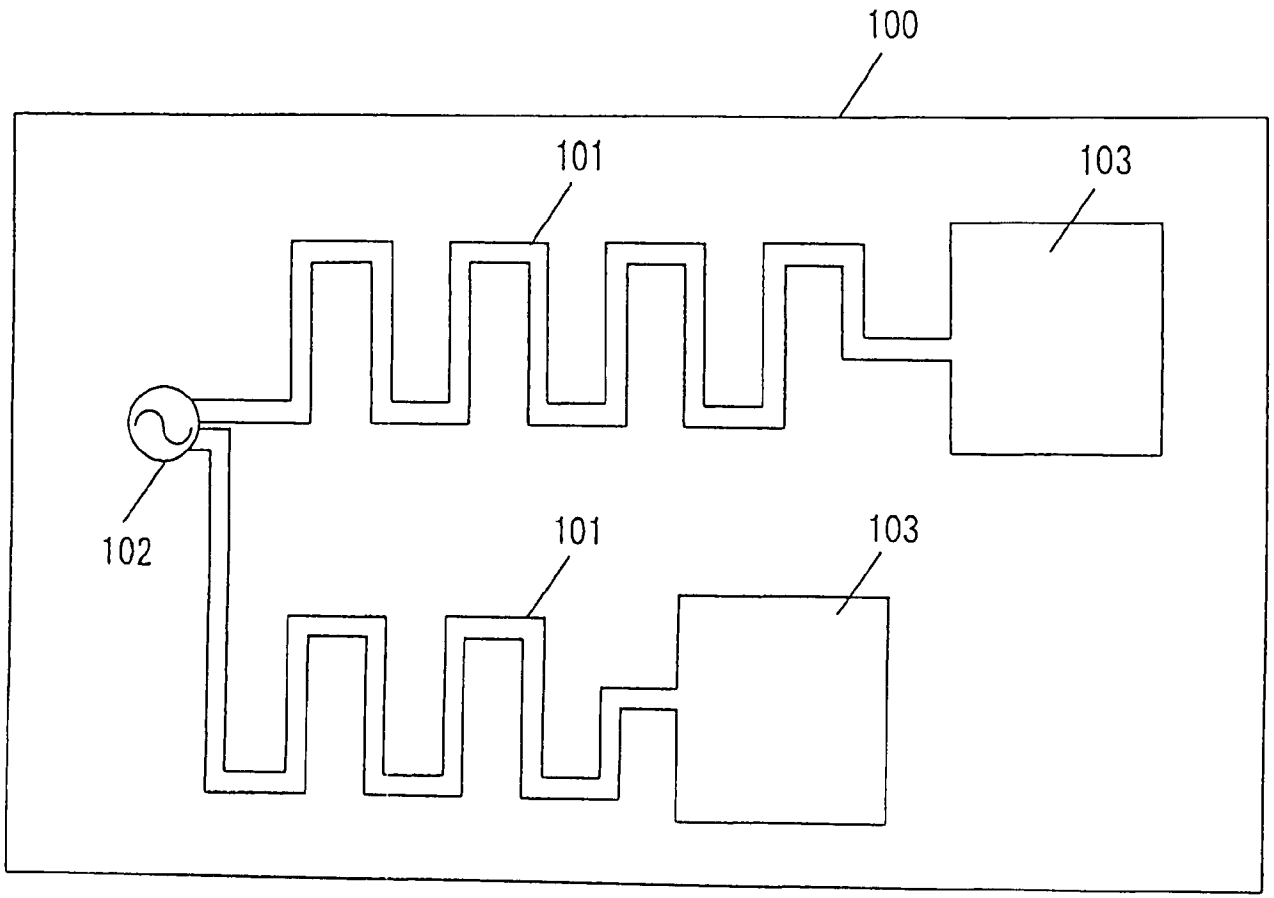
FIG. 38 is a top view of an antenna module in a related art.

The three frequencies are brought close to each other (at this time, the frequency band at second chip antenna and the total frequency band at second and third chip antennas are connected in series, the connection conductor and the additional conductor are shared, and the capacitance component is increased, so that each band is put into a wide band) and the frequency curves are smoothly concatenated, so that the antenna module can be provided with a wide band as a whole, as shown in FIG. 36.

According to the above-discussed embodiments, a circuit board is described as an installation body for installing the chip antenna. The present invention is not limited thereto. An installation board, an installation plate, a circuit board, etc. can be used as the installation body to which the chip antenna is mounted. Specifically, a circuit and an element including the chip antenna are installed on the installation body. The installation body is formed of a dielectric material of a glass epoxy substrate, etc.

Further, according to the above-discussed embodiments, a chip antenna having base body with conductive film to which laser trimming is subjected is described. However, the present invention is not limited thereto. The chip antenna is an installation-type chip antenna having a base body and an antenna section on the surface or inside of the base body. The antenna section is formed with a conductor section of a metal film, a metal face, a metal plate, a metal rod, etc., a conductor section provided by printing a conductive pattern, etc. The conductor section is formed at least on the surface or inside of the base body for emitting a radio wave as a signal current is supplied, as the antenna section.

Figure 30:
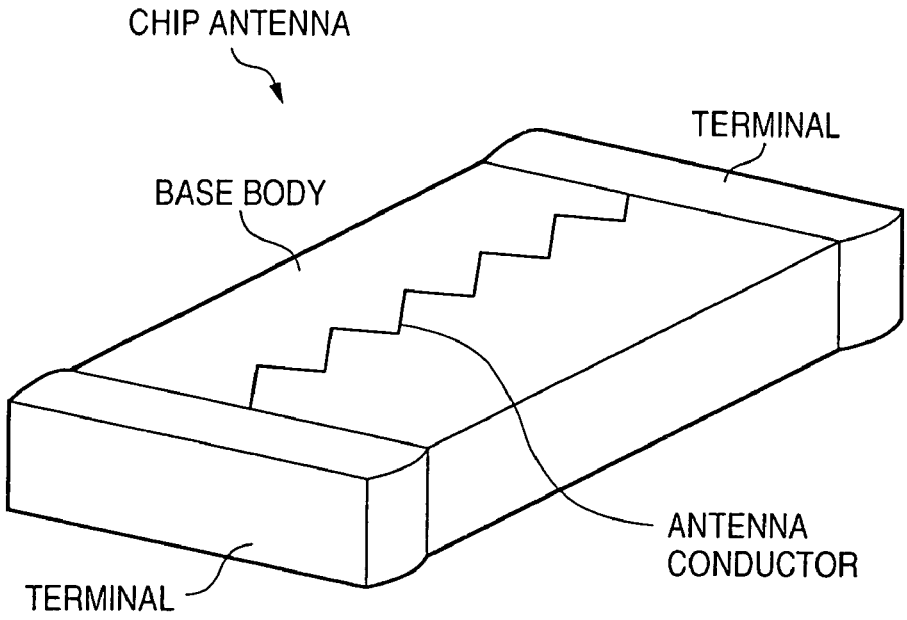
FIGS. 30 to 34 show variations of chip antennas.
Figure 31:
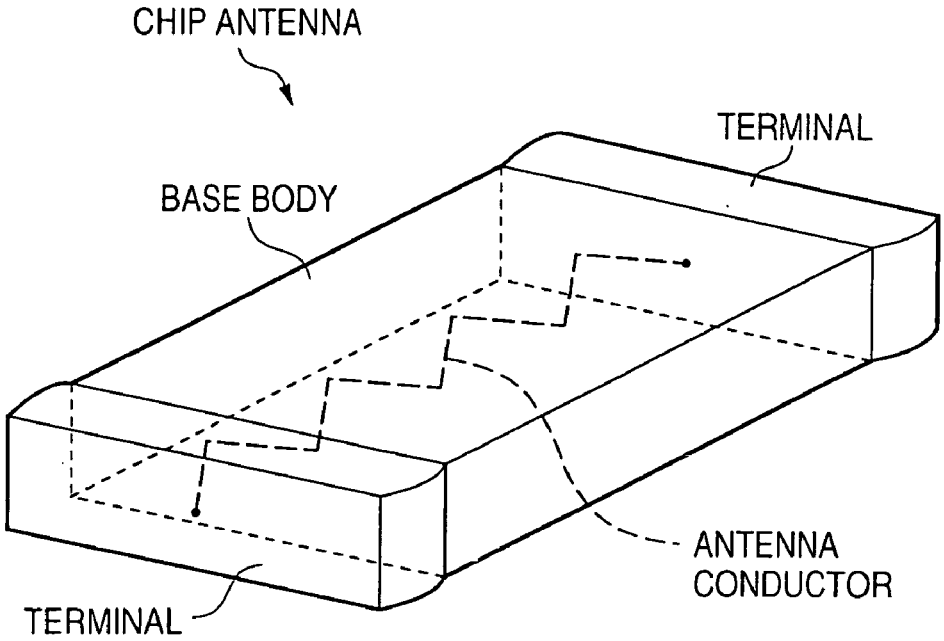
Figure 32:
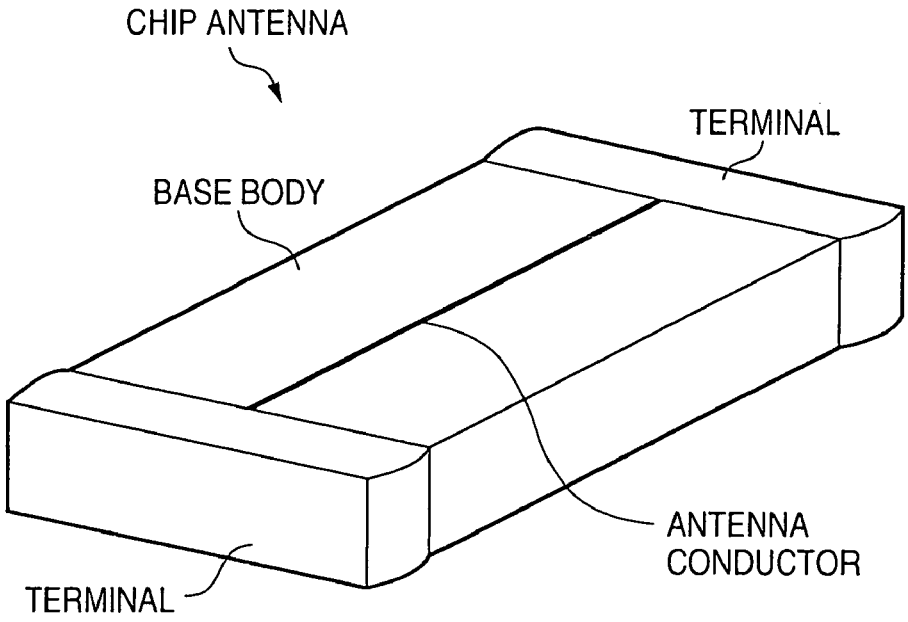
Figure 33:
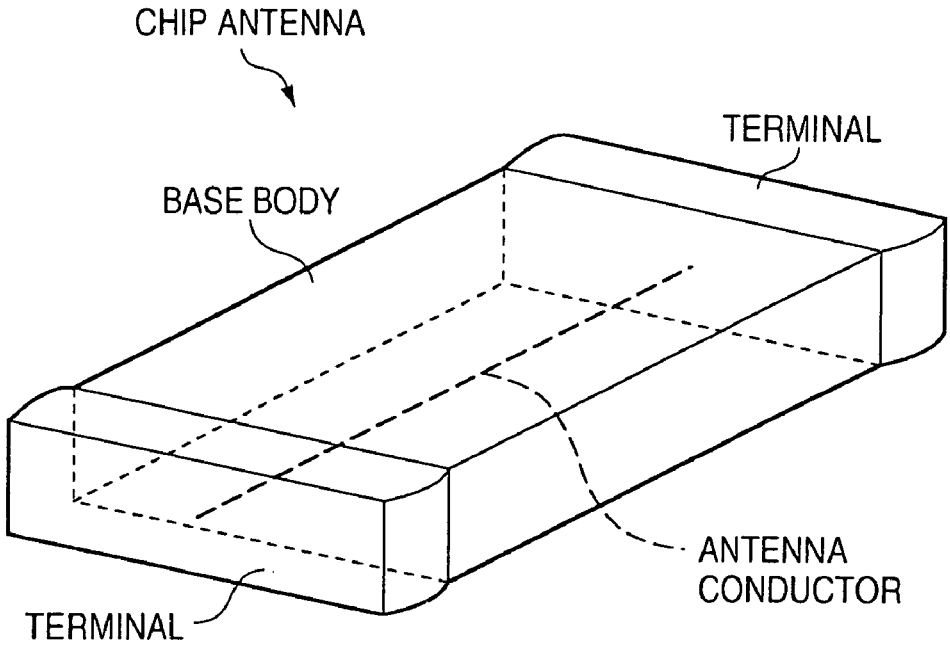
Figure 34:
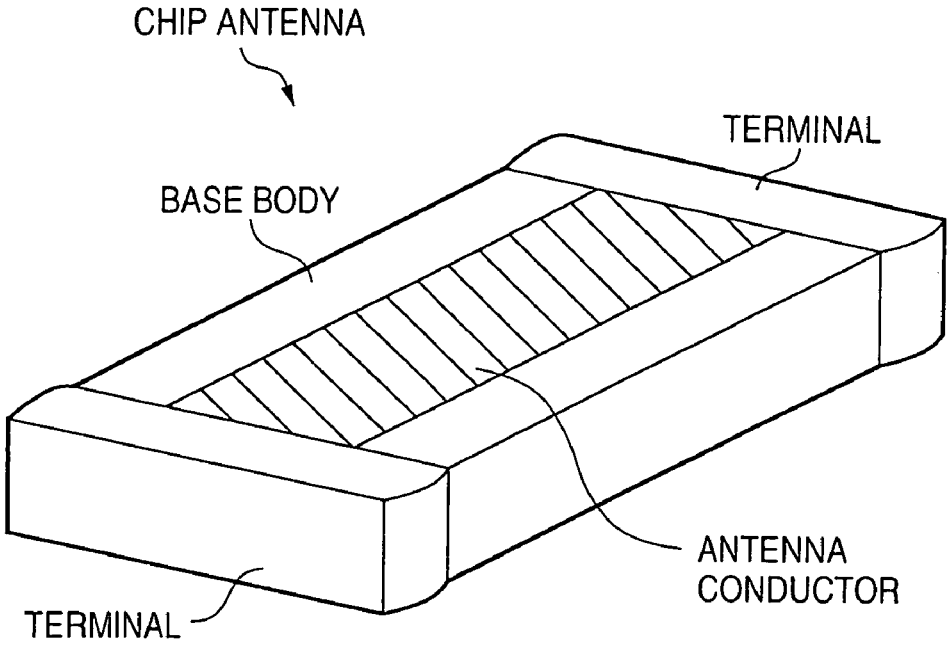

As the structure of the antenna section, a meander-shaped conductor section may be provided on the surface of the base body as shown in FIG. 30; a meander-shaped conductor section may be provided in the base body as shown in FIG. 31; a linear or rod-shaped conductor section may be provided on the surface of the base body as shown in FIG. 32; a linear or rod-shaped conductor section may be provided in the base body as shown in FIG. 34; or a planar conductor section may be provided on the surface of the base body as shown in FIG. 35.

According to the present invention, the antenna apparatus has two antennas having close and different resonance frequencies and the feeding section for supplying common power to the feeding terminals of the two antennas, wherein the open terminals of the two antennas are separate, so that a wide band can be provided and the antenna apparatus can also be applied to the application in which it is necessary to accomplish communications at a high transmission rate requiring a wide band.

Further, the antenna module of the invention includes a plurality of antennas, a connection conductor being provided between the antennas for connecting the antennas in series, a feeding section being provided in one of terminal sections to which the connection conductor is not connected in the plurality of antennas connected in series, and an additional conductor being provided in the other of terminal sections to which the connection conductor is not connected, wherein the additional conductor is an open end part. Thus, as the connection conductor is used in the connection section for connecting the antennas, the connection conductor has a capacitance component and the Q value of the antenna module is decreased because of the capacitance component of the connection conductor, enabling the antenna module to be applied to the application in which the antenna module needs to be provided with a wide band.

This application is based upon and claims the benefit of priority of Japanese Patent Applications No. P2003-308501 filed on Sep. 1, 2003 and P2003-410042 filed on Dec. 9, 2003, the contents of which are incorporated herein by reference in their entirety.

What is claimed is:

1. An antenna module comprising:

an installation body; and a plurality of chip antennas located on said installation body, each of said plurality of chip antennas having a different resonant frequency, wherein a terminal section of each of said plurality of chip antennas is connected to a common current feeder line such that a common current signal from a feeding source is receivable by said plurality of chip antennas through the common current feeder line, said plurality of chip antennas are connected in parallel, and end parts of said plurality of chip antennas opposite to said terminal sections of said plurality of chip antennas are isolated from each other, at least two of said plurality of chip antennas forms a first antenna group of a first transmission-reception frequency band, said at least two chip antennas having different resonance frequencies that are close to each other, and at least two of said plurality of chip antennas that are different from said at least two chip antennas of the first antenna group forms a second antenna group of a second transmission-reception frequency band that is different from the first transmission-reception frequency band, said at least two different chip antennas having different resonance frequencies that are close to each other.

2. The antenna module as claimed in claim 1, wherein the different resonant frequencies are in a range of 10 MHz to 200 MHz.

3. The antenna module as claimed in claim 1, wherein at least one of said plurality of chip antennas is an installation-type chip antenna having a base body, an antenna section at least one of on a surface and inside of said base body, and an additional conductor connected to said terminal section of said at least one chip antenna.

4. The antenna module as claimed in claim 1, wherein at least two of said plurality of chip antennas that are different from said at least two chip antennas of the first and second antenna groups forms a third antenna group of a third transmission-reception frequency band that is different from the first and second transmission-reception frequency bands.

5. The antenna module as claimed in claim 4, wherein a one of the first to third antenna groups having a highest transmission-reception frequency band is connected to the common current feeder line at a position nearer to the feeding source than the other antenna groups and as the transmission-reception frequency bands of the other antenna groups become lower, the corresponding antenna groups are connected to the common current feeder line at positions farther from the feeding source.

6. The antenna module as claimed in claim 3, wherein at least one of the common current feeder line and said additional conductor is also an installation land of said installation body.

7. An electronic apparatus comprising:

an antenna module as claimed in claim 1;

a high frequency circuit for processing transmission and reception signals for said antenna module;

a processing circuit connected to said high frequency circuit, said processing circuit for performing data processing; and a control circuit for controlling said processing circuit and said high frequency circuit.

8. The electronic apparatus as claimed in claim 7, wherein at least one of said plurality of chip antennas is an installation-type chip antenna having a base body and an antenna section at a part of at least one of on a surface and inside of said base body.

9. The electronic apparatus as claimed in claim 7, further comprising at least one additional chip antenna connected in series with one of said plurality of chip antennas.

10. The electronic apparatus as claimed in claim 7, wherein said electronic apparatus is a portable terminal.

11. A selection diversity apparatus comprising:

a plurality of said antenna modules as claimed in claim 1;

a selection section for selecting between reception signals received by said plurality of antenna modules;

a detection section for detecting a selected reception signal from said selection section;

a power calculation section for calculating a power of the detected signal from said detection section and generating a calculation result; and a demodulation section for demodulating the detected signal into data, wherein said selection section is operable to select between the reception signals of said plurality of antenna modules in response to the calculation result of said power calculation section.

12. A combined diversity apparatus comprising:

a plurality of said antenna modules as claimed in claim 1;

a combining section for combining reception signals received by said plurality of antenna modules;

a detection section for detecting a combined reception signal from said combining section;

a power calculation section for calculating a power of the detected signal from said detection section and generating a calculation result; and a demodulation section for demodulating the detected signal into data, wherein said combining section is operable to combine the reception signals in response to the calculation result of said power calculation section.

13. The combined diversity apparatus as claimed in claim 12, wherein said combining section is operable to combine the reception signals by performing maximum ratio combining.

14. An antenna module comprising:

an installation body; and a plurality of chip antennas located on said installation body, each of said plurality of chip antennas having a pair of terminal sections;

a connection conductor connecting a first of said pair of terminal sections of a first of said plurality of chip antennas with a first of said pair of terminal sections of a second of said plurality of chip antennas;

an additional conductor connected to a second of said pair of terminal sections of said second chip antenna; and a capacitance conductor being electrically connected to said additional conductor, and being located at and not electrically connected to at least one of said first and second chip antennas, wherein said connection conductor connects said plurality of chip antennas in series to form an antenna group, and in the antenna group, a second of said pair of terminal sections of said first chip antenna is adapted to receive a common signal current.

15. An electronic apparatus comprising:

an antenna module as claimed in claim 14;

a high frequency circuit for processing transmission and reception signals for said antenna module;

a processing circuit connected to said high frequency circuit, said processing circuit for performing data processing; and a control circuit for controlling said processing circuit and said high frequency circuit.

* * * * *